US009033460B2

(12) United States Patent
Ito et al.

(10) Patent No.: US 9,033,460 B2
(45) Date of Patent: May 19, 2015

(54) IMAGE FORMING APPARATUS CAPABLE OF COLLECTING INK MIST

(75) Inventors: Yoichi Ito, Tokyo (JP); Akiyoshi Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 162 days.

(21) Appl. No.: 12/914,358

(22) Filed: Oct. 28, 2010

(65) Prior Publication Data

US 2011/0109692 A1 May 12, 2011

(30) Foreign Application Priority Data

| | | |
|---|---|---|
| Nov. 9, 2009 | (JP) | 2009-255641 |
| Feb. 1, 2010 | (JP) | 2010-020617 |
| May 31, 2010 | (JP) | 2010-125027 |

(51) Int. Cl.

| | |
|---|---|
| ***B41J 2/165*** | (2006.01) |
| ***B41J 2/17*** | (2006.01) |
| ***B41J 2/185*** | (2006.01) |

(52) U.S. Cl.

CPC ..... *B41J 2/185* (2013.01); *B41J 2/1714* (2013.01)

(58) Field of Classification Search

None

See application file for complete search history.

(56) References Cited

U.S. PATENT DOCUMENTS

| | | | | | |
|---|---|---|---|---|---|
| 4,051,485 | A * | 9/1977 | Yamada | 347/77 |
| 4,250,510 | A * | 2/1981 | Dressler | 347/76 |
| 6,158,844 | A * | 12/2000 | Murakami et al. | 347/55 |
| 7,246,890 | B2 * | 7/2007 | Yamada et al. | 347/77 |
| 7,591,551 | B2 | 9/2009 | Imoto et al. | |
| 2003/0122903 | A1 * | 7/2003 | Yamada et al. | 347/77 |
| 2008/0018707 | A1 | 1/2008 | Masuyuma et al. | |
| 2009/0052917 | A1 | 2/2009 | Kogure et al. | |

FOREIGN PATENT DOCUMENTS

| | | |
|---|---|---|
| JP | 7-101082 | 4/1995 |
| JP | 10-264412 | 10/1998 |
| JP | 2002-211005 | 7/2002 |
| JP | 2005-349799 | 12/2005 |
| JP | 2006-82286 | 3/2006 |
| JP | 2006-175743 | 7/2006 |
| JP | 2007-021840 | 2/2007 |

OTHER PUBLICATIONS

Oct. 29, 2013 Japanese official action in connection with corresponding Japanese patent application No. 2010-125027.

* cited by examiner

*Primary Examiner* — Alejandro Valencia

(74) *Attorney, Agent, or Firm* — Cooper & Dunham LLP

(57) ABSTRACT

An image forming apparatus includes a recording head that discharges an electrically substantially neutral droplet of ink onto a recording medium; a transport unit that transports the recording medium such that a recording surface of the recording medium is substantially orthogonal with respect to an ink discharge direction of the recording head; and an electric field generating unit that generates an electric field when the recording head discharges the droplet of ink. The electric field is substantially parallel to the ink discharge direction in terms of intensity.

12 Claims, 31 Drawing Sheets

IMAGE FORMING APPARATUS CAPABLE OF COLLECTING INK MIST

BACKGROUND OF THE INVENTION

1. Field of the Invention

The present invention generally relates to image forming apparatuses for forming an image on a recording medium. Particularly, the present invention relates to an inkjet image forming apparatus that forms an image by discharging droplets of a recording fluid onto a recording medium.

2. Description of the Related Art

An inkjet image forming apparatus is known in which droplets of a recording fluid (such as ink) are discharged from a recording head in order to form an image on a recording medium, such as a sheet of paper. Because of the principle of operation of the inkjet image forming apparatus, a part of an ink droplet may be separated as the droplet travels through the space between the recording head and the recording medium, or upon landing on the recording medium. Such separated droplet portions may be scattered in the form of an ink mist, which may remain attached to various surfaces within the image forming apparatus.

The ink mist attached within the image forming apparatus may stain the hand of a user accessing the inside of the apparatus, particularly if the mist accumulates as a layer of dirt or grime. The ink mist may also attach to various sensors within the apparatus, such as optical sensors for detecting a sheet in the image forming apparatus or encoder sensors for detecting a carriage position. As a result, detection accuracy of the sensors may decrease, thereby adversely affecting the recording medium transport function of the image forming apparatus, or resulting in degraded image quality.

In order to prevent the attachment of the ink mist within the image forming apparatus, a technology according to Patent Document 1, for example, collects the mist by causing the mist to be adsorbed on a surface at an appropriate location within the apparatus by using static electricity or corona discharge. At the same time, the technology also makes locations where prevention of mist attachment is desired electrically conductive, and connect these locations to ground. By thus preventing the locations from being charged, the attaching of mist to these locations may be prevented.

In order to collect the mist, a technology according to Patent Document 2 provides a discharge electrode for charging an ink mist and a dust-collecting electrode for collecting the charged ink mist. According to this technology, the discharge electrode and the dust-collecting electrode are supplied with a high voltage from a high-voltage circuit for generating a high voltage used for charging a recording medium transport belt.

However, the technology according to Patent Document 1 is not capable of controlling the amount of charge of the mist, so that the proportion of the charged mist or its intensity may vary. Further, because the charge of the mist also varies greatly depending on the environment, the mist cannot be collected with high efficiency. The technology according to Patent Document 2 requires a separate charging unit for charging the mist, resulting in a cost increase. Further, the efficiency with which the mist can be charged is rather low because of the nature of mist.

Patent Document 1: JP10-264412A

Patent Document 2: JP2005-349799A

SUMMARY OF THE INVENTION

The disadvantages of the prior art may be overcome by the present invention which, in one aspect, is an image forming apparatus that includes a recording head that discharges an electrically substantially neutral droplet of ink onto a recording medium; a transport unit that transports the recording medium such that a recording surface of the recording medium is substantially orthogonal with respect to an ink discharge direction of the recording head; and an electric field generating unit that generates an electric field when the recording head discharges the droplet of ink. The electric field is substantially parallel to the ink discharge direction in terms of intensity.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENTS

Figure 1:
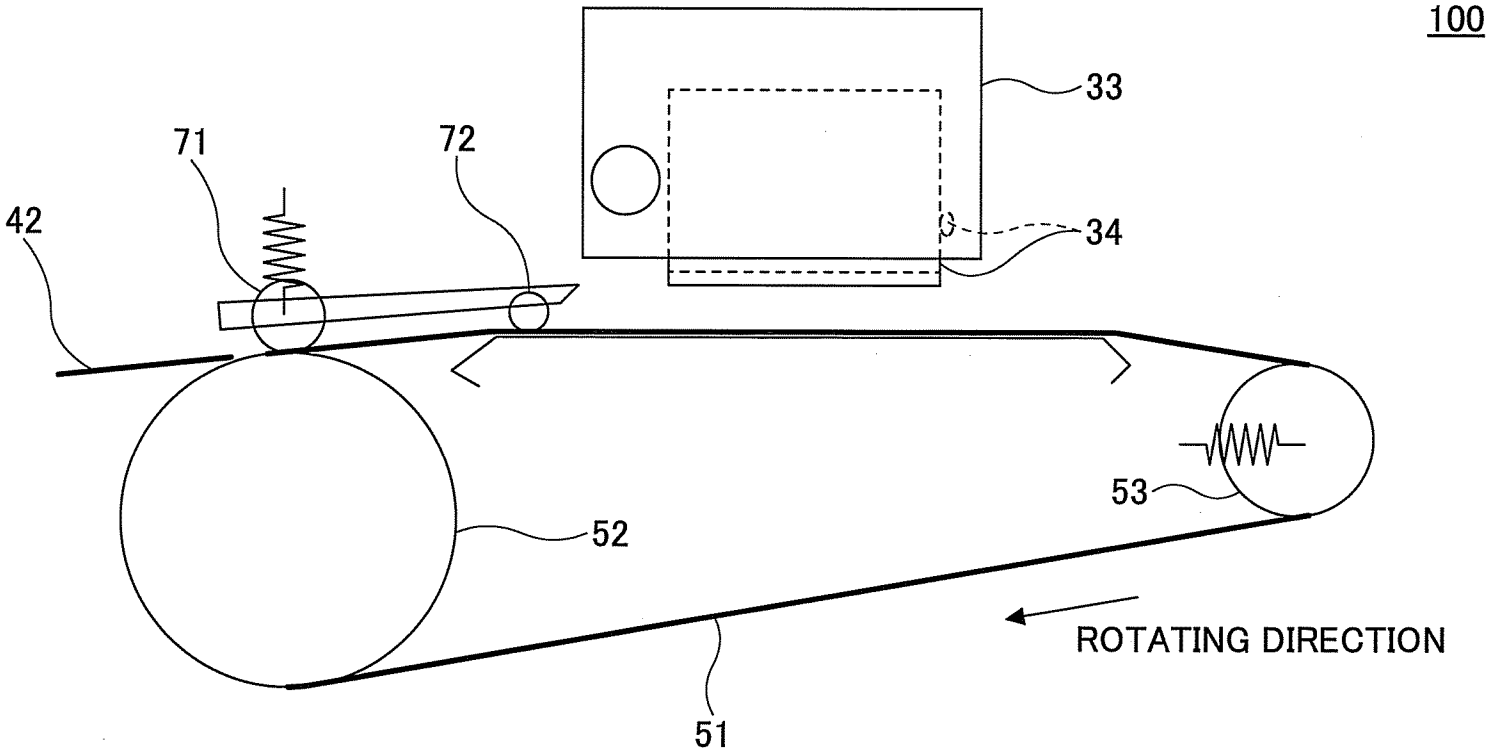
FIG. 1 is a side view of a main portion of an image forming apparatus according to an embodiment of the present invention.

Referring now to the drawings, wherein like reference numerals designate identical or corresponding parts throughout the several views, FIG. 1 is a schematic side view of a main portion of an inkjet image forming apparatus 100 according to an embodiment of the present invention. A sheet 42 of recording material (which may be referred to as a "recording medium") is conveyed to a recording area opposite a recording head 34 by a transport belt 51. During the conveying, the sheet 42 is in close contact with the transport belt 51 due to a first pressure roller 71 and a second pressure roller 72. The recording head 34 discharges droplets of a recording fluid, such as ink, onto the sheet 42 in the recording area.

Figure 2:
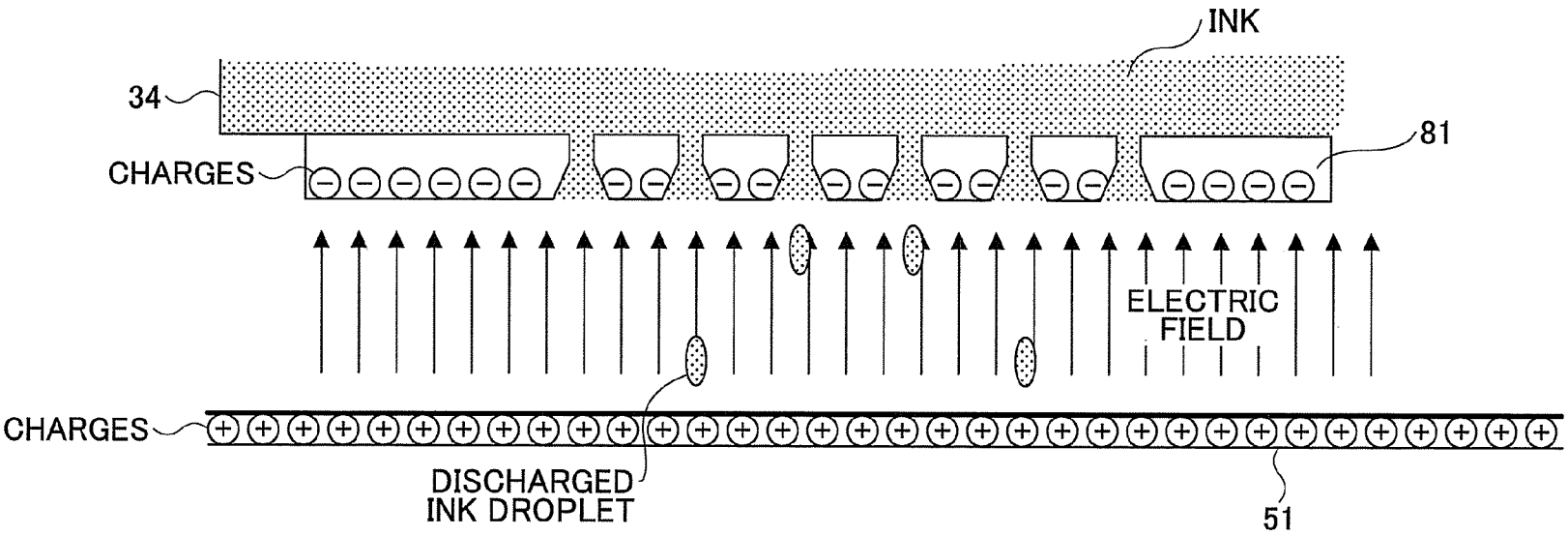
FIG. 2 is an enlarged view of a droplet discharge area of the image forming apparatus of FIG. 1.

FIG. 2 is an enlarged view of a droplet discharge portion of the recording head 34. When ink droplets are discharged, the inkjet image forming apparatus 100 produces an electric field in a direction substantially parallel to a direction in which the ink droplets are discharged. For example, in the case of FIG. 2, the recording head 34 has a nozzle plate 81 made of an electrically conductive material. The nozzle plate 81 is negatively charged, while the transport belt 51 is uniformly positively charged. As a result, an electric field is formed between the transport belt 51 and the nozzle plate 81 in a direction substantially parallel to the ink discharge direction. A method of forming such an electric field is described later.

Figure 3:
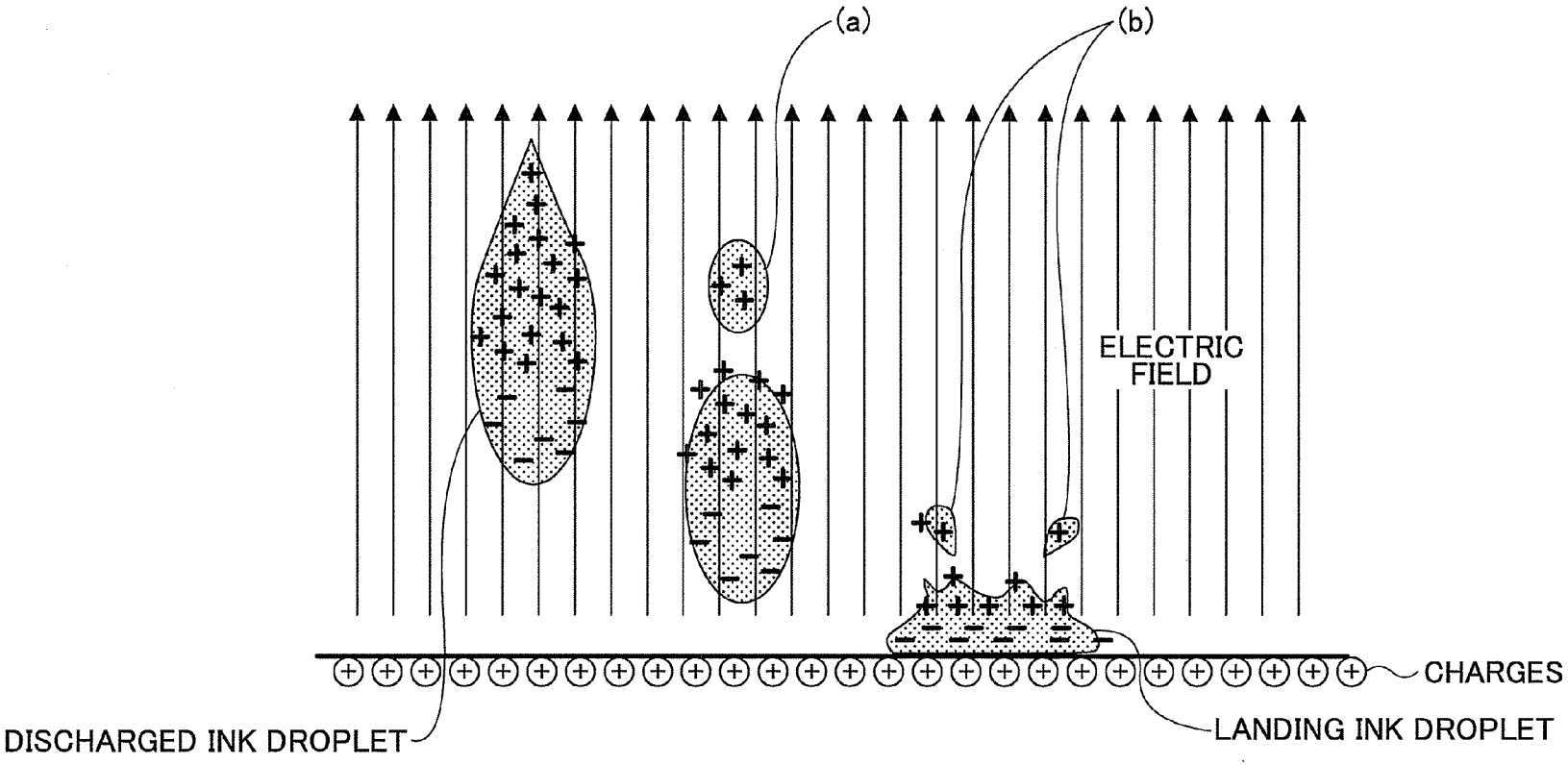
FIG. 3 illustrates how mist is produced from discharged ink droplets.

FIG. 3 illustrates how mist of ink is produced from ink droplets. As illustrated, mist is mainly produced when a rear-end portion (a) of a droplet is separated, or when a droplet is bounced off the recording medium, separating into small portions (b). When the mist is produced in the presence of a uniform electric field, the distribution of charges of the mist is shifted in one direction (because of electrostatic induction) even if the droplets are originally electrically neutral. When the transport belt 51 is positively charged as illustrated, negative charges are induced in a portion of the droplets nearer the transport belt 51, while positive charges are induced in a portion of the droplets nearer the nozzle plate 81. Because the separated ink portions (a) and (b) are nearer the nozzle plate 81, they are positively charged, and therefore the resultant mist made of those separated portions (a) and (b) is also positively charged. Namely, the mist is no longer electrically neutral. Thus, the mist tends to be adsorbed on the negatively charged nozzle plate 81 or the like, enabling the collection of the mist within the inkjet image forming apparatus 100.

While the foregoing description was made with reference to the transport belt 51 and the electrically conductive nozzle plate 81, the mist can be similarly charged in an image forming apparatus of the type in which the recording medium is transported by a platen mechanism, instead of the transport belt 51, as long as there is the electric field substantially parallel to the discharge direction when the ink droplets are discharged.

Figure 4:
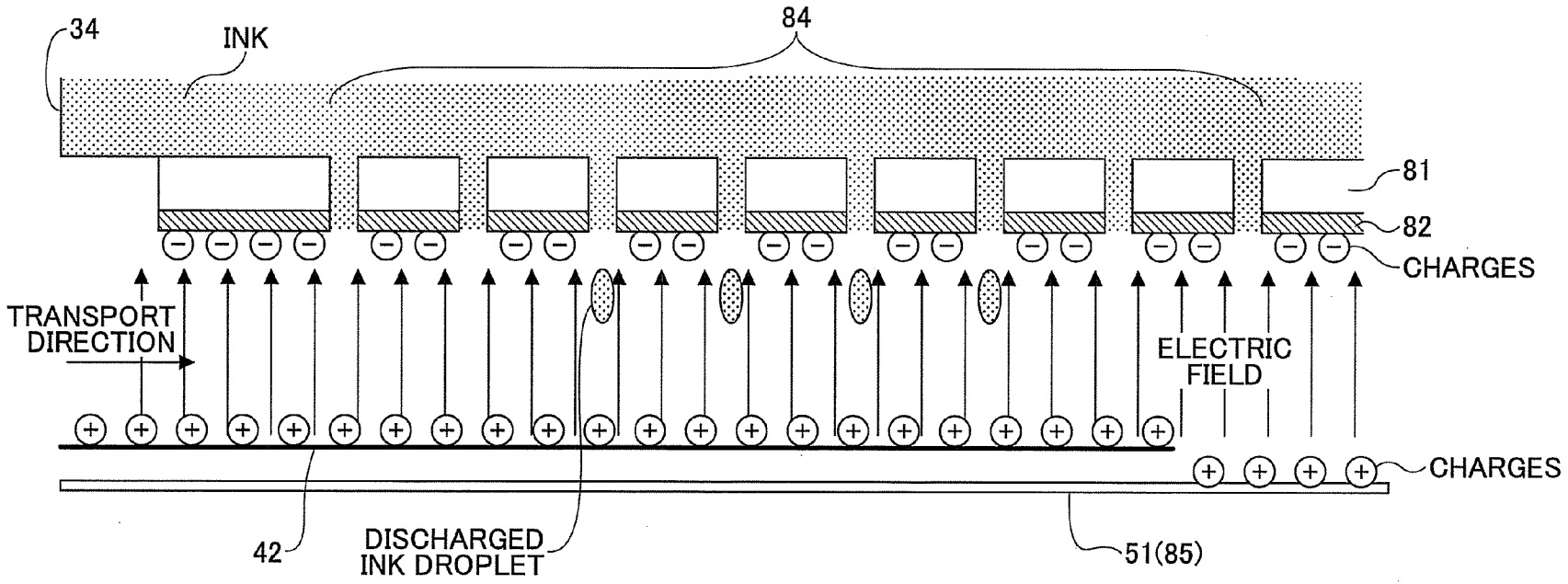
FIG. 4 schematically illustrates a method of generating an electric field during the discharge of ink droplets.

FIG. 4 illustrates another configuration for providing an electric field during the discharge of droplets. The sheet 42 of recording material is transported on the transport belt 51 in a direction indicated by an arrow. The recording head 34 is disposed substantially parallel to and opposite the sheet 42. The recording head 34 is configured to discharge ink droplets onto the sheet 42 in a direction perpendicular to the sheet while the recording head 34 is moved along a guide rod 31 (see FIG. 5).

In FIG. 4, the nozzle plate 81 includes a charging portion 82 on a side facing the transport belt 51. The charging portion 82 is configured to uniformly charge at least a surface of the nozzle plate 81 negatively or positively. Alternatively, the entire nozzle plate 81 may be configured to be charged. In the example of FIG. 4, the surface of the charging portion 82 of the nozzle plate 81 is negatively charged by a supply of electric power. When the surface of the nozzle plate 81 is thus negatively charged, the surface of the sheet 42 facing the nozzle plate 81 is positively charged by induced polarization.

The positive charges on the sheet 42 and the negative charges on the nozzle plate 81 cause an electric field to be produced in a direction substantially parallel to the discharge direction (vertically with respect to the sheet). The intensity of the electric field may be controlled by the magnitude of the charges on the charging portion 82, so that the charges of the mist can also be controlled. The charges of the mist may be substantially proportional to the intensity of the electric field. Alternatively, the sheet 42 may be negatively charged and the nozzle plate 81 may be positively charged.

Figure 5:
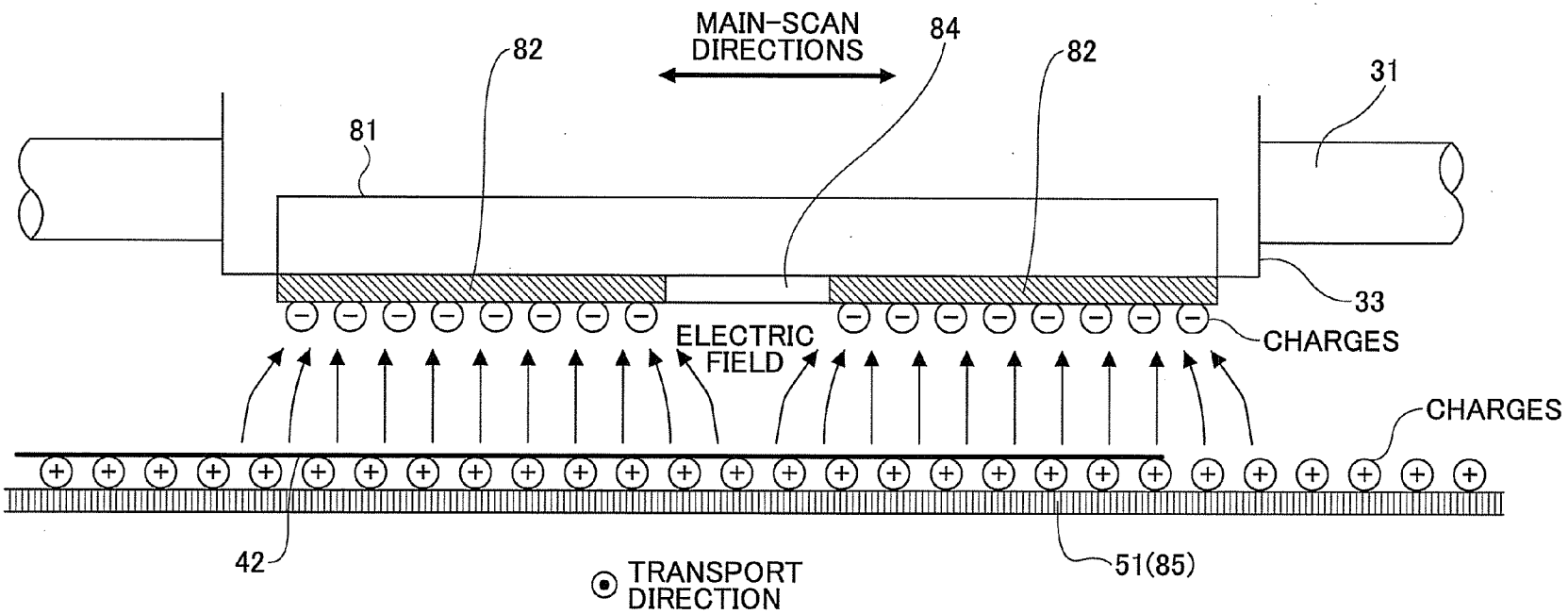
FIG. 5 illustrates another method of generating an electric field during the discharge of ink droplets.

FIG. 5 illustrates another method of charging the nozzle plate 81 and the sheet 42. In the example of FIG. 5, the recording head 34 is mounted on a carriage 33 so that the recording head 34 can be slidably moved along the guide rod 31 (horizontally in the drawing). While the nozzle plate 81 may include the charging portion 82, the transport belt 51 is charged by a supply of charges (hereafter, the surface of the transport belt 51 that is charged may be referred to as a "transport surface 85").

The sheet 42 is subjected to induced polarization by the positive charges on the transport surface 85 of the transport belt 51, so that the sheet 42 is internally negatively charged nearer the transport belt 51 and positively charged nearer the nozzle plate 81. Thus, an electric field similar to the one illustrated in FIG. 4 is produced. The transport belt 51 may be charged by various other methods. One method may utilize the alternating charges used for causing the sheet 42 to be attached onto the transport belt 51. Instead of charging the transport belt 51, a platen that is a transport mount for the sheet 42 may be charged. When ribs are formed on the platen in a direction parallel to the sheet transport direction, the ribs may be charged.

Figure 6:
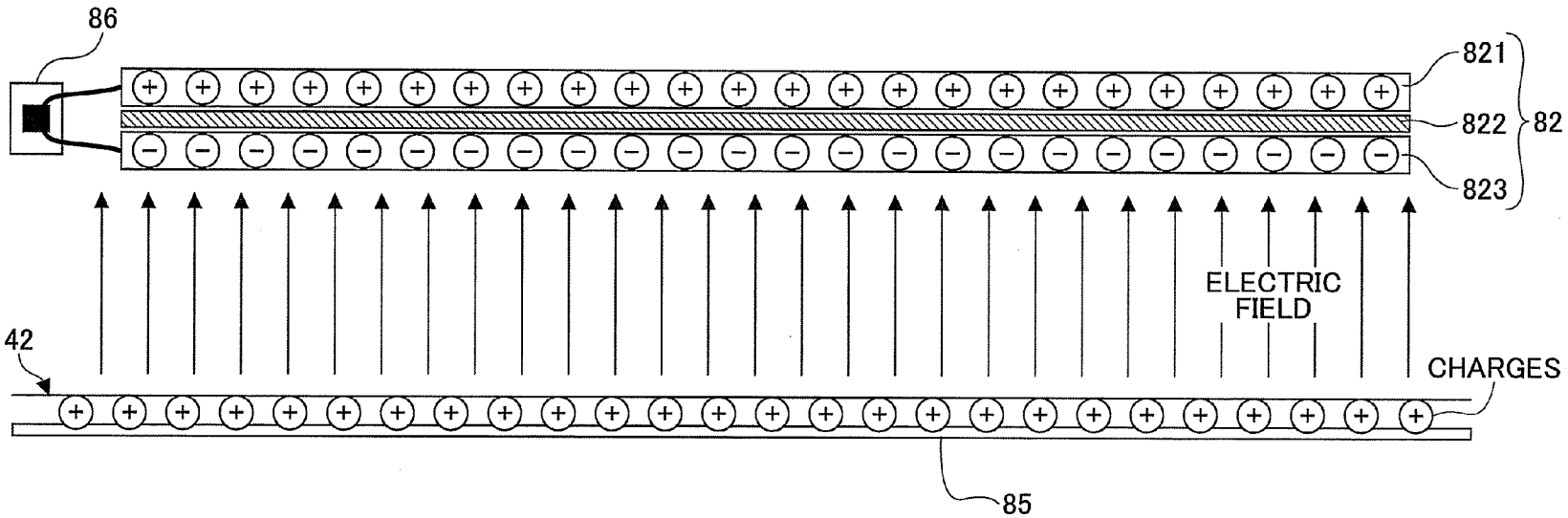
FIG. 6 illustrates a nozzle plate charging mechanism.

FIG. 6 illustrates an example of the charging portion 82 of the nozzle plate 81. In this example, the charging portion 82 comprises a capacitor that is not supplied with electric power, as opposed to the example of FIG. 4. When the transport surface 85 of the transport belt 51 is positively charged, the sheet 42 is subjected to negative induced polarization on the side nearer the transport belt 51. As a result, the sheet 42 is positively charged on the side nearer the nozzle plate 81. Accordingly, the charging portion 82 of the nozzle plate 81 is negatively charged by electrostatic induction. Thus, the required electric field can be produced by actively charging the transport belt 51.

In the example of FIG. 5, the charging portion 82 is disposed on either side of the nozzle area 84, in contrast to the example of FIG. 4 where the charging portion 82 is disposed in the nozzle area 84. In the example of FIG. 5, the polarities of the charges of the transport surface 85 and the nozzle plate 81 may be reversed. With reference to FIG. 4, a method of charging the nozzle plate 81 itself and a method of providing the charging portion 82 in the nozzle area 84 of the nozzle plate 81 have been described. With reference to FIG. 5, a method of providing the charging portion 82 laterally adjacent the nozzle plate 81 has been described. Further, with reference to FIG. 4, a method of charging the surface of the sheet 42 has been described, and with reference to FIG. 5 a method of charging the transport belt 51 has also been described. Namely, some methods provide the charges from the nozzle plate side, and some other methods do so from the transport belt side. The described methods may be used in any desired ways or combinations. For example, both the nozzle plate 81 and the transport belt 51 may be supplied with electric power and charged. Alternatively, a more appropriate method may be adopted depending on the ionization tendency determined by the composition of the ink.

The above methods are not limited to the transport belt system illustrated in FIG. 1 but may also be applied to the platen of a rib transport type or an air suction type as long as the methods are capable of causing charges to be carried on the transport surface 85 of the sheet 42 illustrated in FIG. 4 or 5.

Advantages and disadvantages of the charging methods described with reference to FIG. 4 are discussed. First, regarding the method by which the nozzle area 84 of the nozzle plate 81 or the nozzle plate 81 itself is charged, the electric field can act nearer the droplets as they are discharged out of the nozzle and more horizontally with respect to the discharge direction. Thus, the mist can be easily charged, and the distribution of the charges can be efficiently controlled.

On the other hand, it is technically difficult to dispose the charging portion 82 in the nozzle area 84 of the nozzle plate 81, and doing so may adversely affect the performance of the recording head 34. Further, because the polarities of the charges of the mist and the nozzle plate 81 are opposite, the mist may be drawn to the nozzle plate 81 and attach thereto, possibly resulting in a discharge defect. Furthermore, if a portion of the nozzle plate 81 that comes into contact with the ink is charged, charge exchange may occur between the ink and the nozzle plate 81, possibly resulting in a redox reaction, as will be described in detail later.

When charges are caused to be carried on the transport surface 85 of the transport belt 51 by induced polarization, as illustrated in FIG. 4, processing of the sheet 42 may be facilitated on the sheet-ejecting end because of the absence of direct charging of the sheet 42. If the sheet 42 is charged, the sheet 42 itself may be drawn to the opposite charges on the nozzle plate 81. However, in the case where the charges are carried on the transport belt 51 by induced polarization, there is no fear of the sheet 42 being drawn upward or floating. In addition, carrying charges on the transport belt 51 is also advantageous in that the sheet 42 can be held on the transport belt 51 more strongly and therefore the sheet 42 can be transported more easily by neutralizing the surface of sheet 42. However, in the example of FIG. 4, the distance between the nozzle area 84 and the charged surface (85) needs to be increased, resulting in a decrease in the intensity of the electric field.

An advantage of providing the charging portion 82 laterally adjacent the nozzle area 84 in the example of FIG. 5 is discussed. In this case, the problems of the mist attaching to the nozzle plate 81 and the charge exchange between the ink and the nozzle plate 81 are eliminated. However, because the electric field is produced outside the nozzle area 84, the direction of the electric field may not be parallel to the droplet discharge direction as illustrated in FIG. 5, so that charging the mist may become harder, and the charge control efficiency may worsen.

As described above, the mist can be charged even though the ink as discharged may be neutral by forming the controlled electric field in the process of mist generation. Because there is a correlation between the charge of the mist and the intensity of the electric field, the amount of charge of the mist can be controlled. A stable quality of ink can be obtained because no charges are carried on the discharged droplets (i.e., electrically neutral ink is discharged). If the ink itself carries charges, charge exchange may occur between the ions in the ink and the electrodes, resulting in anode corrosion on the positive side and cathode corrosion on the negative side (i.e., redox reaction). As a result, the composition of the ink may be changed, or ionized metals may be freed from the electrode metal surface, instantaneously crystallizing. Further, if the electrode fed with charges corrodes, a film may be formed on the electrode surface, thereby preventing the feeding of charges. In accordance with the present embodiment, such problems can be avoided.

FIG. 6 illustrates the charging portion 82 of a capacitor type according to an embodiment of the present invention. The charging portion 82 may be mounted on the nozzle plate 81 illustrated in FIG. 4 or 5. When mounted on the nozzle plate 81 of FIG. 4, electric power may be supplied from a connection-switching mechanism 86. The charging portion 82 comprises two electrodes 821 and 823 with a dielectric (insulator) 822 disposed therebetween. The two electrodes 821 and 823 are electrically connected to the connection-switching mechanism 86.

The two electrodes 821 and 823 of the capacitor portion may be charged by various methods. In one method, an electric potential difference may be actively provided by the connection-switching mechanism 86. In another method, one of the electrodes 821 and 823 may be charged with charges on the transport surface 85 by electrostatic induction. The latter method may not be capable of forming a strong electric field easily, and may require that the nozzle plate 81 be located very close to the reverse potential body, i.e., the transport surface 85. On the other hand, charging by electrostatic induction does not require a mechanism for producing a potential difference on the nozzle plate 81, so that the structure of the recording head can be simplified, even though the mist charging efficiency may decrease to some extent.

In the example of FIG. 6, the charging portion 82 is charged by charges on the transport surface 85 by electrostatic induction. The polarities of the charges of the electrodes 821 and 823 may be reversed.

Figure 7:
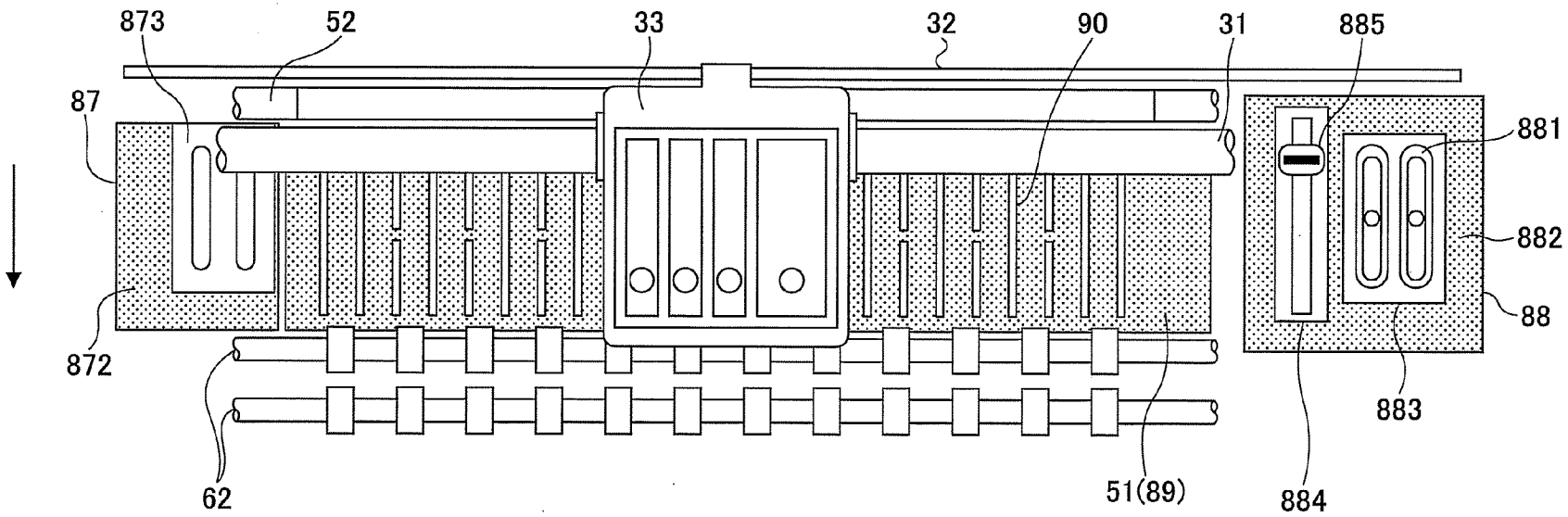
FIG. 7 is a plan view of the image forming apparatus of FIG. 1.

Referring to FIG. 7, collection of the ink mist is described. FIG. 7 is a plan view of a main portion of the image forming apparatus 100, showing the carriage 33, a blank discharge unit 87, and a maintenance unit 88 among others. The carriage 33 carries the ink cartridges of various colors and is configured to be moved along the guide rod 31. The transport belt 51 (endless belt) is extended across the transport roller 52 and a driven roller 53 (see FIG. 1). The transport belt 51 may be rotated in a sub-scan direction perpendicular to the axis of the guide rod 31, as indicated by an arrow. The sheet 42 (not shown in FIG. 7; see FIGS. 1 and 30, for example) is transported in the sub-scan direction while being held on the transport belt 51 by static electricity or an air suction force. The sheet 42 is eventually ejected onto an external tray.

The transport belt 51 is of the platen type on which ribs 90 are provided extending in the transport direction of the sheet 42. Areas of the transport belt 51 other than the ribs 90 provide a platen-area mist absorbing portion 89. The blank discharge unit 87 is provided on one end of the carriage 33. The maintenance unit 88 is provided on the other end of the carriage 33. The blank discharge unit 87 includes a blank-discharge-area mist absorbing portion 872 and a blank-discharge receiver 873. The maintenance unit 88 includes a maintenance-area mist absorbing portion 882, a cleaning unit 884, and a capping unit 883. The cleaning unit 884 includes a cleaning blade 885, and the capping unit 883 includes a cap 881.

In the inkjet image forming apparatus 100 illustrated in FIG. 7, the charged mist may be collected by utilizing an existing discharged-ink absorbing portion in common with the blank-discharge-area mist absorbing portion 872 or the maintenance-area mist absorbing portion 882. The "existing discharged-ink absorbing portion" refers to the blank-discharge receiver 873 or the cleaning unit 884, and may also include areas around them. By commonly utilizing the blank-discharge-area mist absorbing portion 872 or the maintenance-area mist absorbing portion 882 with the existing discharged-ink absorbing portion, the mist can be collected in a large-capacity discharged-ink receiving portion, as well as reducing cost by sharing. As a result, maintenance or replacement of the maintenance unit 88 may be eliminated up to the end of the life of the apparatus. When the inkjet image forming apparatus 100 is provided with a replaceable ink tank as a discharged-ink absorbing portion, the ink tank may be replaced together with the collected mist. Thus, the mist can be disposed of together with the discharged ink, eliminating the need for maintenance of the blank-discharge-area mist absorbing portion 872 or the maintenance-area mist absorbing portion 882.

During mist collection, the mist may be firmly fixed to the surface of the blank-discharge-area mist absorbing portion 872 or the maintenance-area mist absorbing portion 882. By commonly utilizing the existing discharged-ink absorbing portion with the blank-discharge-area mist absorbing portion 872 or the maintenance-area mist absorbing portion 882, the mist may be dissolved by a solvent in the discharged-ink, depending on the composition of the ink. Thus, decrease in mist collection efficiency caused by the fixing of the mist to the surface of the mist collecting portion may be prevented.

In the example of FIG. 7, the maintenance-area mist absorbing portion 882, the blank-discharge-area mist absorbing portion 872, or the platen-area mist absorbing portion 89 may be charged so that the mist can be easily drawn to them. When the blank-discharge-area mist absorbing portion 872, the maintenance-area mist absorbing portion 882, or the platen-area mist absorbing portion 89 are configured to absorb the mist using an ink absorbing material, such as fibers, there is desirably no potential difference between the mist (ink) and the absorbing material so that the mist can smoothly seep through the material and be absorbed thereby. The potential difference may be eliminated by physically switching the charges of the absorbing material, or by charge exchange between the mist and the absorbing material.

When the platen-area mist absorbing portion 89 is configured to collect mist, it is necessary to reverse the polarities of the charges on the transport surface 85 when charging the mist and when collecting the mist. Namely, as illustrated in FIG. 3, when the transport surface 85 (transport belt 51) is positively charged, the mist becomes also positively charged. Therefore, at the time of mist collection, the transport surface 85 needs to be negatively charged, so that the mist can be attracted by the platen-area mist absorbing portion 89.

Figure 8:
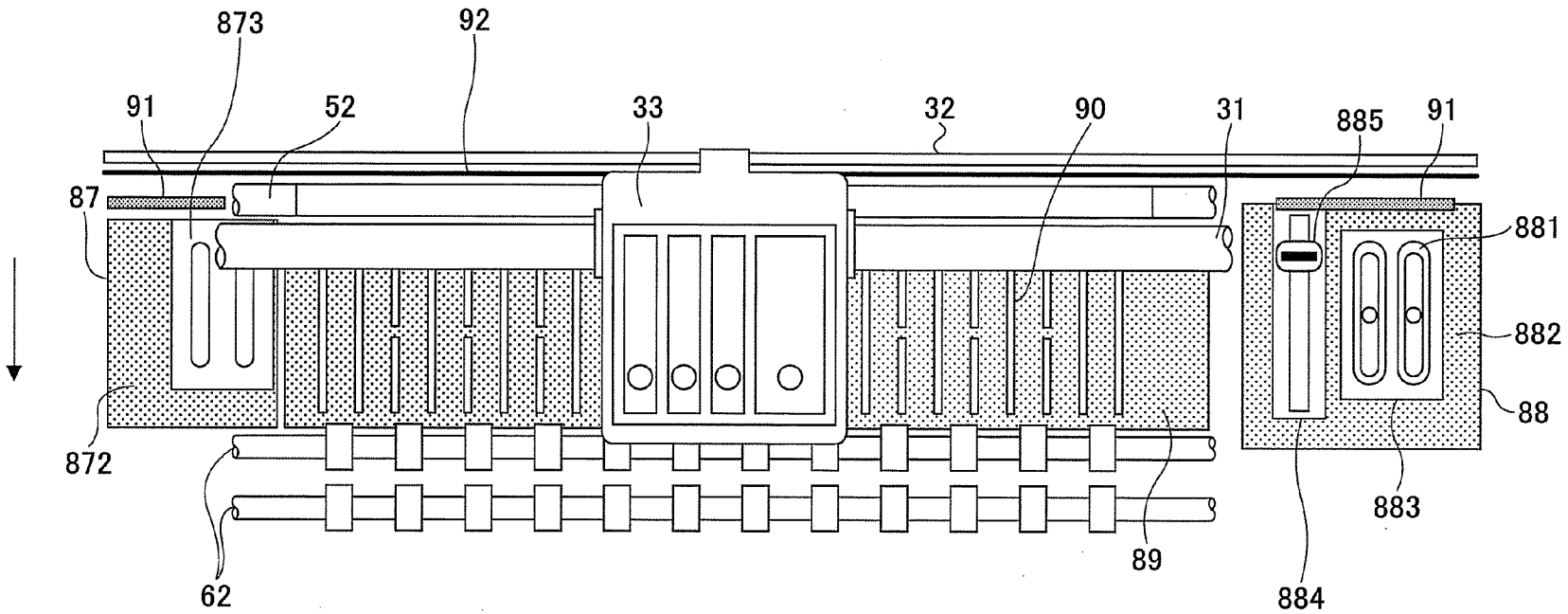
FIG. 8 is another plan view of the image forming apparatus of FIG. 1, illustrating a method of collecting ink mist.

FIG. 8 illustrates another configuration for collecting mist. In addition to the configuration of FIG. 7, the configuration of FIG. 8 includes a charging portion 91 for repelling the mist. The charging portion 91 has the same potential as the mist and is disposed near the existing discharged-ink absorbing portion (blank discharge unit 87 and maintenance unit 88), where a large amount of mist is produced. In this configuration, the nozzle plate 81 as a mist producing source may be preferably disposed between an encoder sensor 92, to which the attachment of mist should be avoided, and the mist absorbing bodies. In this way, the mist produced by the nozzle plate 81 in the direction of the platen-area mist absorbing portion 89 can be located farther from the encoder sensor 92, and the mist can be located nearer the mist absorbing portion, so that collection efficiency can be increased.

When the inkjet image forming apparatus 100 has an ink supply system including ink tubing (not shown), an ink tube may be filled with a filling fluid at the time of shipping. Normally, the filling fluid is disposed of as waste ink at the time of initial ink supplying. In the configuration of FIG. 8, the blank-discharge-area mist absorbing portion 872 may be permeated with the disposed filling fluid. In this way, the mist absorbed by the blank-discharge-area mist absorbing portion 872 may be dissolved by the filling fluid, so that the mist can seep deeper and faster into the blank-discharge-area mist absorbing portion 872. In this way, the amount of mist collected can be increased.

Figure 9B:
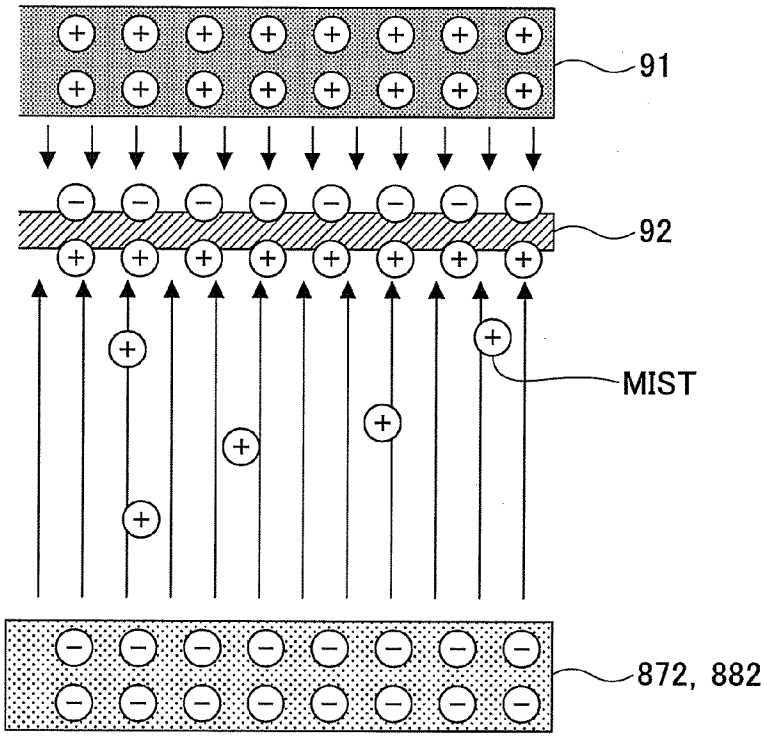
FIGS. 9A and 9B illustrate different ways of operation of the charging mechanism of FIG. 8.
Figure 9A:
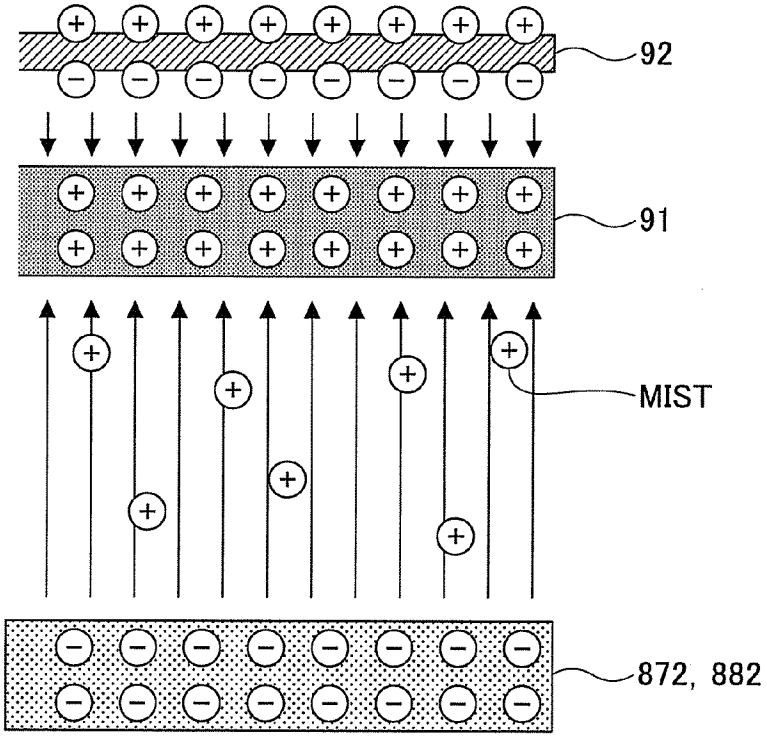

FIGS. 9A and 9B illustrate an operation of the charging portion 91 configured to repel mist as described with reference to FIG. 8. The charging portion 91 may be used with the blank-discharge-area mist absorbing portion 872 or the maintenance-area mist absorbing portion 882 as the mist absorbing body. The charging portion 91 is disposed near the encoder sensor 92 in order to repel the mist away from the encoder sensor 92, as mentioned above. When the encoder sensor 92 comprises an insulator, an electric field is produced in a thickness direction of the encoder sensor 92 by induced polarization, as illustrated in FIG. 9A. Apparently, the encoder sensor 92 is negatively charged on the side facing the charging portion 91.

On the other hand, the mist is positively charged. Therefore, if the mist enters the gap between the mist-repelling portion 91 having the same potential as the mist and the encoder sensor 92, the Coulomb force may cause the mist to attach to the encoder sensor 92. Therefore, the entry of the mist into the gap between the charging portion 91 and the encoder sensor 92 needs to be prevented.

FIG. 9B illustrates a configuration in which the encoder sensor 92 is disposed between the mist-repelling portion 91 and the mist absorbing portion (blank-discharge-area mist absorbing portion 872 or maintenance-area mist absorbing portion 882). In this case, the encoder sensor 92 is positively polarized on the mist source side, i.e., the same charges as the mist. Thus, the attachment of the mist to the encoder sensor 92 may be more easily prevented.

The configuration illustrated in FIG. 9A or 9B may be preferably selected depending on the relative locations of the mist generating source, the mist absorbing body (blank-discharge-area mist absorbing portion 872 or maintenance-area mist absorbing portion 882), and the encoder sensor 92. Specifically, when there is a large space between the mist absorbing body and the encoder sensor 92, the configuration of FIG. 9A may be adopted; if not, the configuration of FIG. 9B may be adopted. Preferably, the mist-repelling portion 91 and the mist absorbing body may be charged oppositely from the examples illustrated in FIGS. 9A and 9B.

Figure 10:
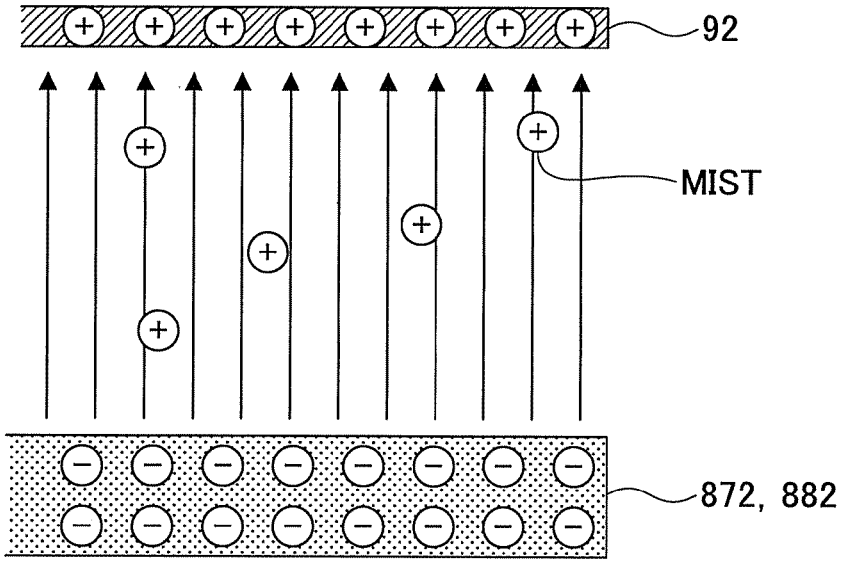
FIG. 10 illustrates a method of collecting mist by charging an encoder sensor.

FIG. 10 illustrates a configuration for collecting the mist by charging the encoder sensor 92 itself with the same potential as the mist. The encoder sensor 92 may comprise a conductive or dielectric material. In this configuration, it may not be easy to form a strong electric field between the encoder sensor 92 and the mist absorbing body (blank-discharge-area mist absorbing portion 872 or maintenance-area mist absorbing portion 882). However, the problem of the staining of the encoder sensor 92 by the entry of mist into the gap between the mist-repelling portion 91 having the same potential as the mist and the encoder sensor 92 can be prevented.

Preferably, the encoder sensor 92 may be charged by electrostatic induction by forming the encoder sensor 92 with a conductive material and grounding a part of the encoder sensor 92. Electrostatic induction may not be capable of forming a strong electric field compared to charging by induced polarization. Thus, the encoder sensor 92 needs to be disposed closer to the reverse potential body, i.e., the mist absorbing body (blank-discharge-area mist absorbing portion 872 or maintenance-area mist absorbing portion 882), resulting in a slightly greater risk of mist attachment. However, this method does not require the mechanism for newly producing a potential difference, so that cost and size reduction can be more readily achieved. The encoder sensor 92 and the mist absorbing body (blank-discharge-area mist absorbing portion 872 or maintenance-area mist absorbing portion 882) may be oppositely charged from the example illustrated in FIG. 10.

Figure 11:
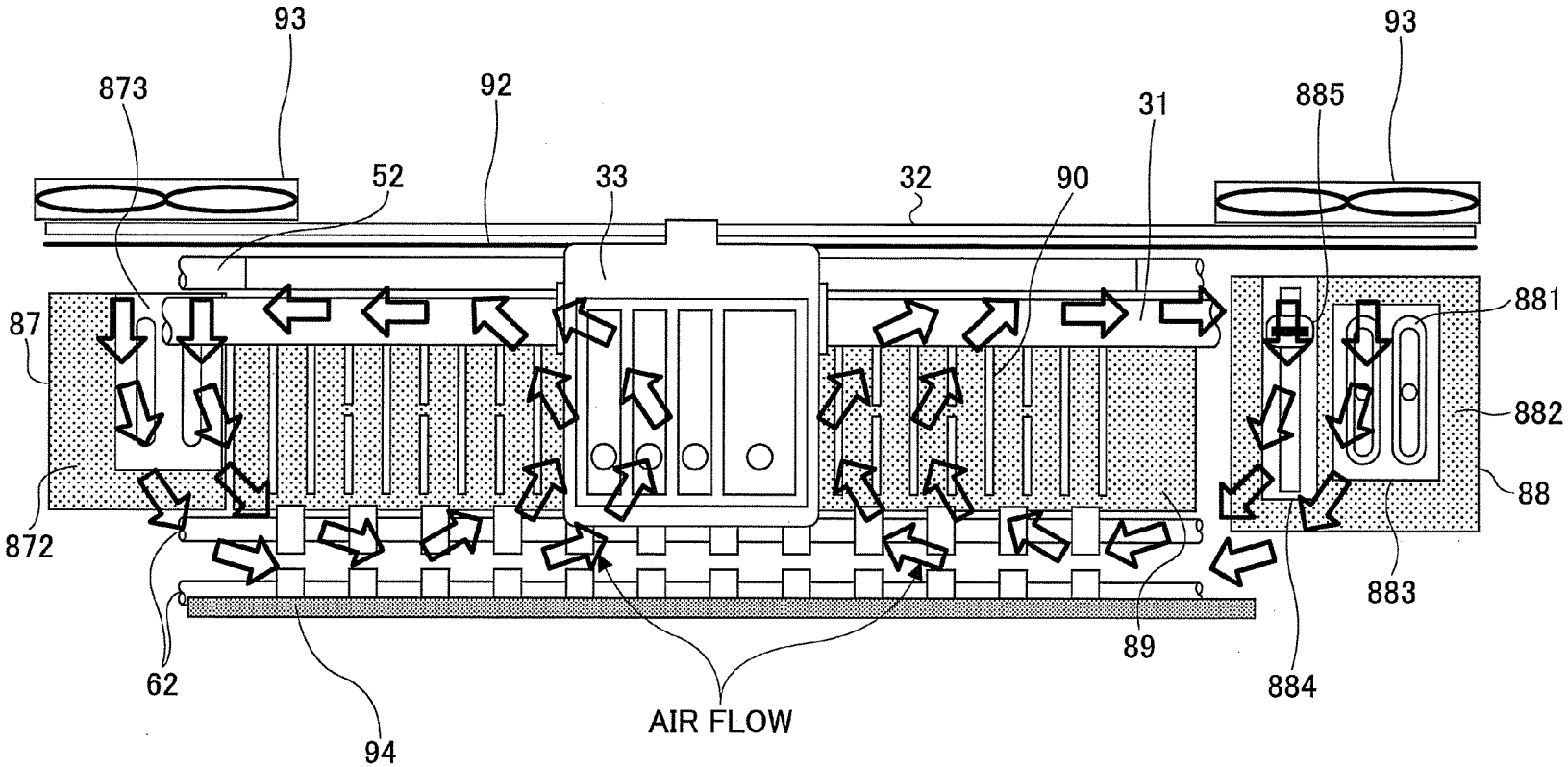
FIG. 11 illustrates an image forming apparatus according to an embodiment of the present invention in which an air flow is utilized to efficiently collect the mist.

FIG. 11 is a plan view of the inkjet image forming apparatus 100 according to another embodiment of the present invention, equipped with a mechanism for efficiently collecting the mist by producing an air flow. The mechanism includes fans 93 configured to produce air flows toward the blank discharge unit 87 and the maintenance unit 88. The air flows are caused to circulate through the blank discharge unit 87 and the maintenance unit 88, where a large amount of mist may be produced, a mist-adsorbing portion 94, the platen-area mist absorbing portion 89, and the encoder sensor 92, as illustrated.

By providing the fan 93 on either side of the inkjet image forming apparatus 100 as illustrated, the air flow circulates in the corresponding side (i.e., on the left and right sides of the drawing), as illustrated. Because the mist-adsorbing body 94 (charging portion) is disposed opposite to the fan 93, the mist produced at the blank discharge unit 87 and the maintenance unit 88 can be efficiency pulled toward the mist-adsorbing portion 94. When the mist is positively charged, the mist-adsorbing portion 94 is negatively charged. Alternatively, the mist may be negatively charged and the mist-adsorbing portion 94 may be positively charged. Preferably, the fans 93 may be commonly used for cooling electronic components (not shown) or for air-suction transport purposes. As illustrated in FIG. 11, the mist-adsorbing portion 94 can be easily disposed opposite the fans 93 without interfering with the other components.

Figure 12:
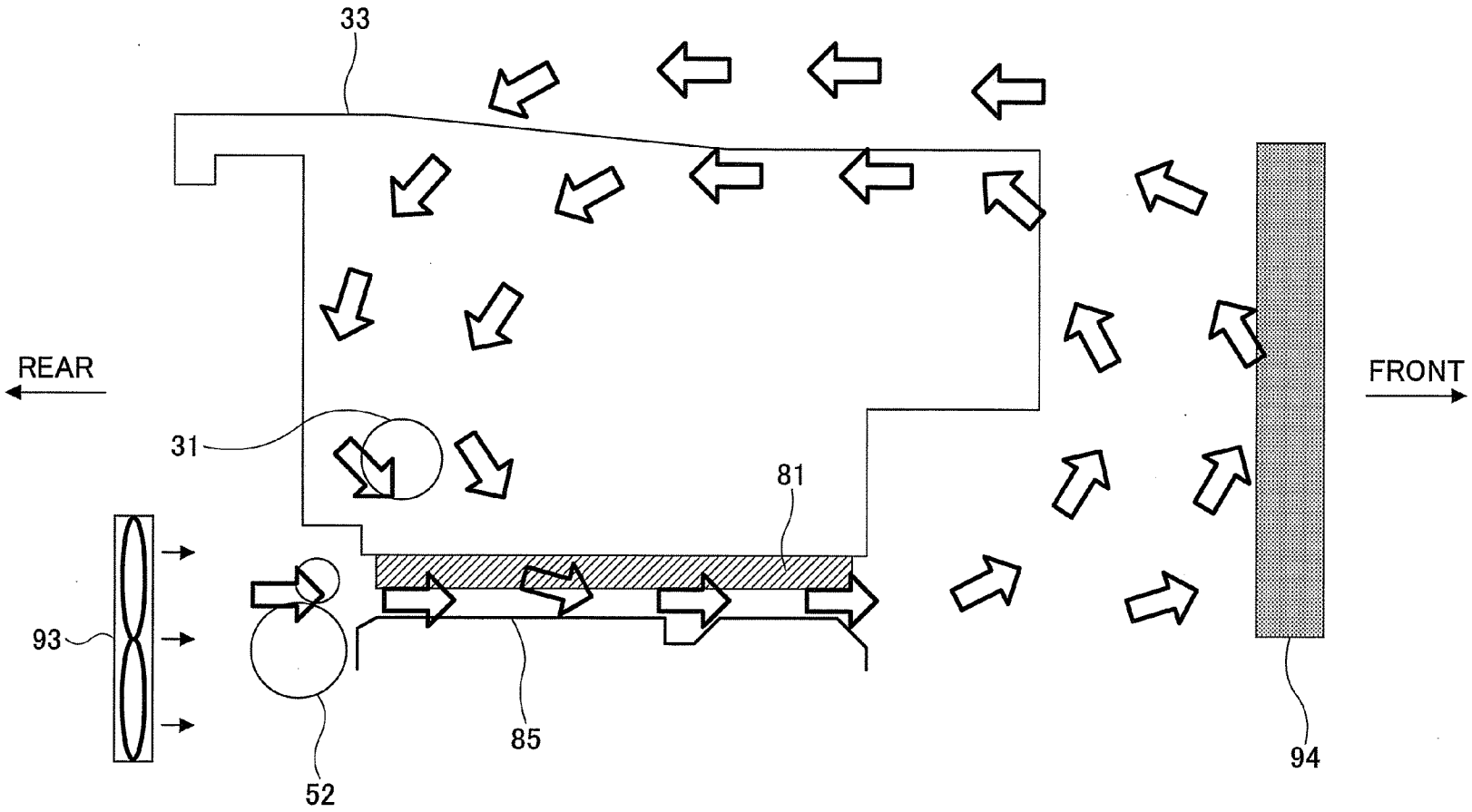
FIG. 12 illustrates another configuration for collecting the mist efficiently by producing an air flow.

FIG. 12 is a side view illustrating another configuration for efficiently collecting mist by producing an air flow. The fan 93 blows air between the nozzle plate 81 and the transport surface 85 toward the mist-adsorbing portion 94. Specifically, the air flow circulates in order of a mist generating source between the nozzle plate 81 and the transport surface 85, the mist-adsorbing portion 94, and the encoder sensor 92 (not shown), producing a circular air flow as illustrated in the side view of FIG. 12.

Thus, by producing the air flow starting from somewhat below the rear (left in the figure) of the apparatus and passing the lower-front portion, and then the upper-front portion of the main portion of the apparatus, the mist can be efficiently collected. In this configuration, the mist can be located away from the encoder sensor 92 (not shown) located in the back (i.e., on the far left of the drawing) of the inkjet image forming apparatus 100. The fan 93 may be commonly used for cooling electronic components and for air suction transport purposes. As illustrated in FIG. 12, the mist-adsorbing portion 94 can be easily installed opposite the fan 93 without interfering with the other components.

When collecting the mist using the air flow as illustrated in FIGS. 11 and 12, it is necessary to prevent the mist from flowing out of the inkjet image forming apparatus 100 because such mist may stain the surface of a mount on which the inkjet image forming apparatus 100 is installed or nearby walls. Thus, the mist absorbing portion may be disposed at an appropriate location within the casing of the image forming apparatus 100, such as in front of an opening in the back surface of the casing of the apparatus facing the fans 93, or in an opening in the upper wall of the casing toward which the air may flow vertically. In this way, the mist can be collected before leaving the apparatus.

Figure 13A:
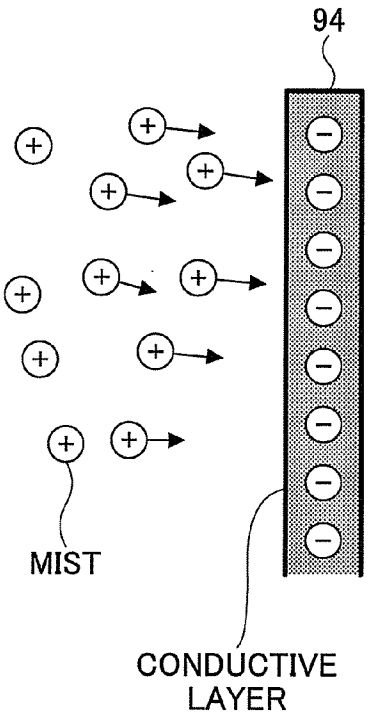
FIGS. 13A through 13C illustrate the process of charge exchange between mist and a charging mechanism (mist absorbing portion)
Figure 13B:
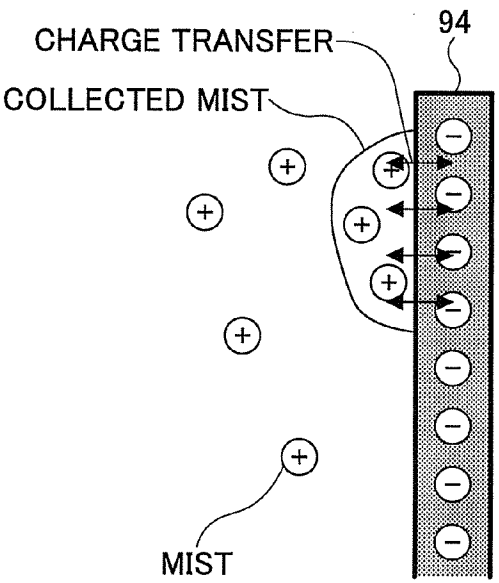
Figure 13C:
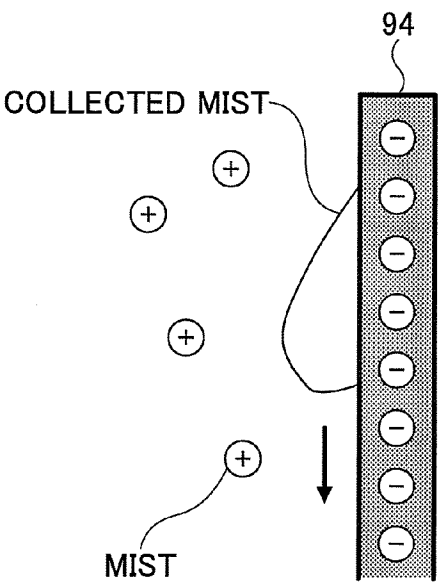

FIGS. 13A through 13C illustrate a process of charge exchange between the mist and the mist-adsorbing portion 94. In the illustrated example, the mist is positively charged while the mist-adsorbing portion 94 is negatively charged (FIG. 13A). Alternatively, the polarities of the mist and the mist-adsorbing portion 94 may be reversed from the illustrated example.

When the mist-adsorbing portion 94 is covered with a conductive layer as illustrated, charges transfer occurs between the mist and the mist-adsorbing portion 94 (FIG. 13B). As a result, the relative potential difference between the collected mist and the mist-adsorbing portion 94 becomes smaller, so that the attraction between them decreases. This causes the collected mist to fall by its own weight (FIG. 13C). In this way, the mist can be prevented from remaining on the collecting portion, so that the amount of mist collected can be increased.

The charge exchange between the ions in the mist and the mist-adsorbing portion 94 may cause corrosion of the surface of the mist-adsorbing portion 94. Because the charges of the mist are small, the problem of corrosion may be prevented by coating the mist-adsorbing portion 94 with an insulating layer, for example.

Figure 14A:
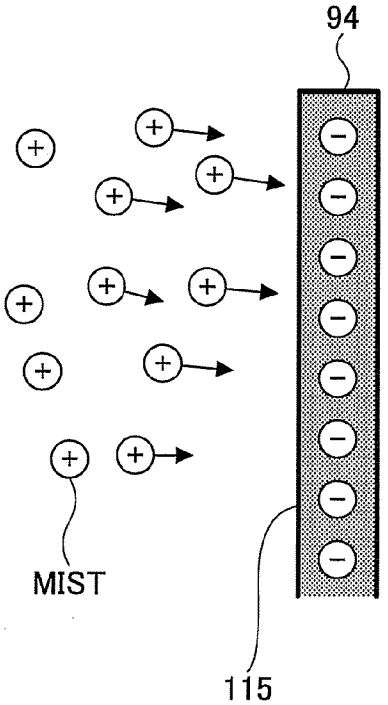
FIGS. 14A through 14C illustrate a charging mechanism (mist absorbing portion) covered with an insulating layer in order to avoid the problem of corrosion of a surface of the charging mechanism (mist absorbing portion)
Figure 14B:
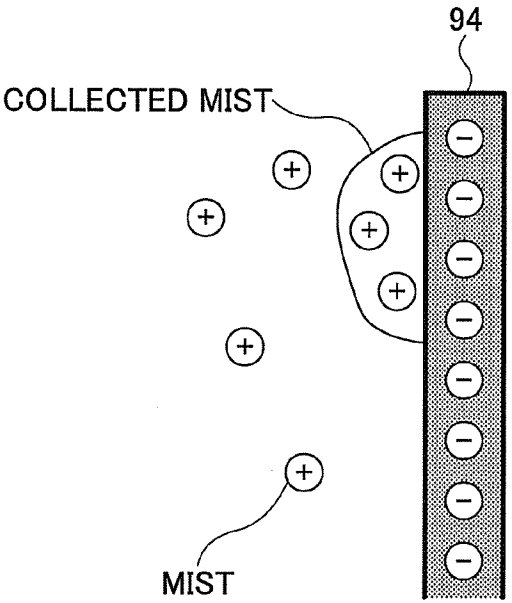
Figure 14C:
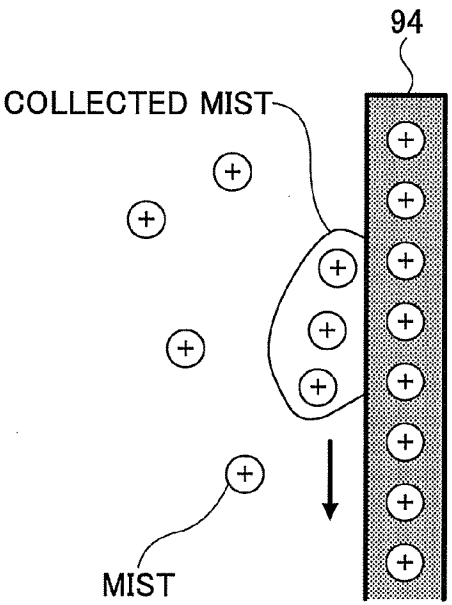

FIGS. 14A through 14C illustrate how the problem of corrosion can be prevented by coating the surface of the mist-adsorbing portion 94 with an insulating layer 115, which may be made of rubber or a resin material. In this case, the problem of corrosion can be prevented. However, the collected mist remains on the surface, thereby lowering the collection efficiency (or the amount collected).

In order to prevent the collected mist from remaining on the adsorbing portion 94 (collecting portion), the polarity of the mist-adsorbing portion 94 may be inverted after mist collection. For example, the potential of the mist-adsorbing portion 94 is switched from negative to positive and vice versa regularly. In this way, a repelling force can be produced between the collected mist and the mist-adsorbing portion 94 (FIG. 14C), thereby causing the collected mist to fall by its own weight.

Alternatively, while not illustrated, the collected mist may be prevented from remaining on the collecting portion by commonly utilizing the discharged-ink absorbing portion, the blank-discharge-area mist absorbing portion 872, and the maintenance-area mist absorbing portion 882. In this way, charge exchange occurs between the discharged ink that is not charged and the collected mist that is charged, so that the potential difference between the mist and the blank-discharge-area mist absorbing portion 872 or the maintenance-area mist absorbing portion 882 can be reduced, allowing the collected ink to fall by its own weight. While in the example of FIG. 14 the mist is positively charged and the mist-adsorbing portion 94 (mist absorbing portion) is negatively charged, the charges may be reversed.

Preferably, a water-repelling coating may be formed instead of, or on top of, the insulating layer 115. The water-repelling coating may comprise a layer of fluorine resin, such as Teflon. In this way, the mist may be collected more easily.

Figure 15A:
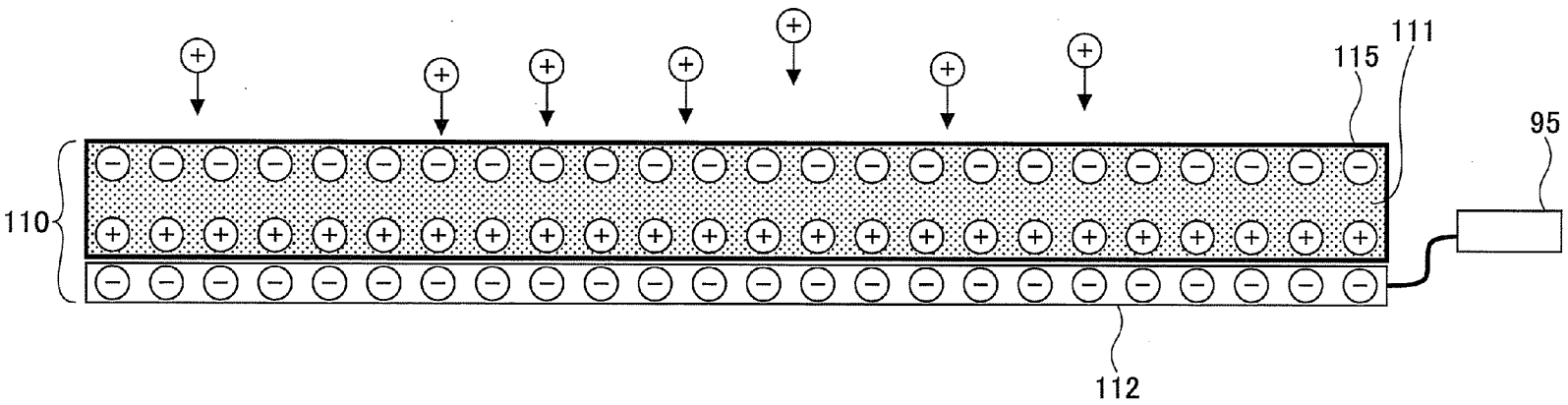
FIGS. 15A and 15B illustrate the switching of the charging mechanism (mist absorbing portion) provided with the insulating coating.
Figure 15B:
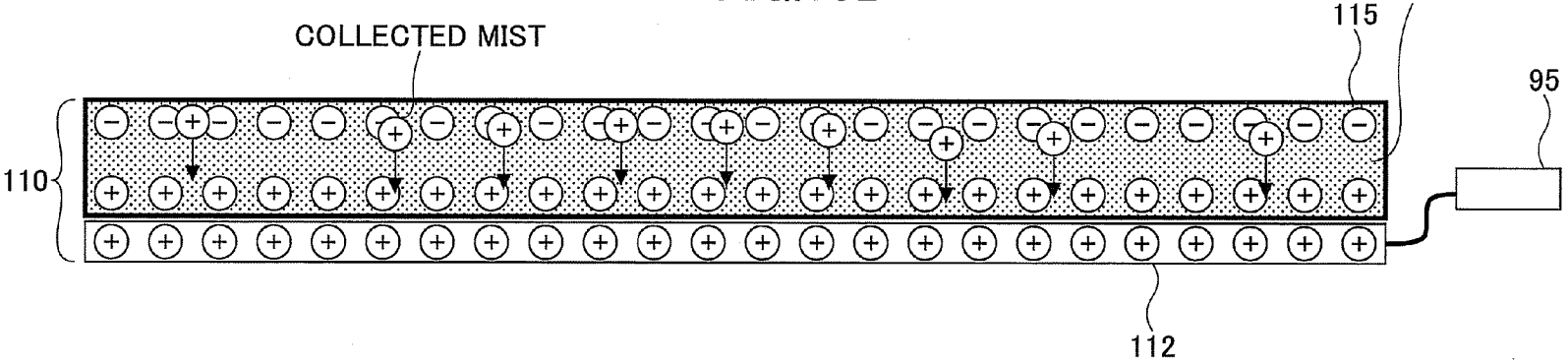

FIGS. 15A and 15B illustrate a mist absorbing portion 110 according to an embodiment of the present invention. The mist absorbing portion 110 may be applied to any of the mist collecting portions (blank-discharge-area mist absorbing portion 872, maintenance-area mist absorbing portion 882, or mist-adsorbing portion 94).

The mist absorbing portion 110 includes an upper layer and a lower layer. The upper layer comprises an absorbing portion 111 capable of absorbing mist and coated with an insulating layer 115 of fibers or the like. The lower layer comprises a conductive layer 112 which is connected to a charge-switching mechanism 95.

The absorbing portion 111 may comprise a spongy material. Because of the insulating layer 115, the absorbing portion 111 is not subject to charge exchange with the mist, so that there is no problem of corrosion of the insulated absorbing portion 111. When attracting the mist, the charge-switching mechanism 95 causes the conductive layer 112 to be charged oppositely from the mist, i.e., negatively as illustrated in FIG. 15A. By thus negatively charging the conductive layer 112, the absorbing portion 111 is positively charged on the side adjacent to the conductive layer 112 and negatively charged on the opposite side by induced polarization. Thus, the positively charged mist is drawn to the negatively charged surface of the insulated absorbing portion 111 by the Coulomb force (FIG. 15A).

Thereafter, the charge-switching mechanism 95 switches the polarities of the charges of the conductive layer 112 in order to prevent the collected mist from remaining on the surface of the insulated absorbing portion 111. Specifically, as illustrated in FIG. 15B, the charge-switching mechanism 95 causes the conductive layer 112 to be positively charged. As a result, the mist collected by the insulated absorbing portion 111 moves toward the conductive layer 112 more easily, so that the mist can be prevented from remaining on the surface of the insulated absorbing portion 111. The polarities of the charges in the illustrated example may be reversed.

Figure 16B:
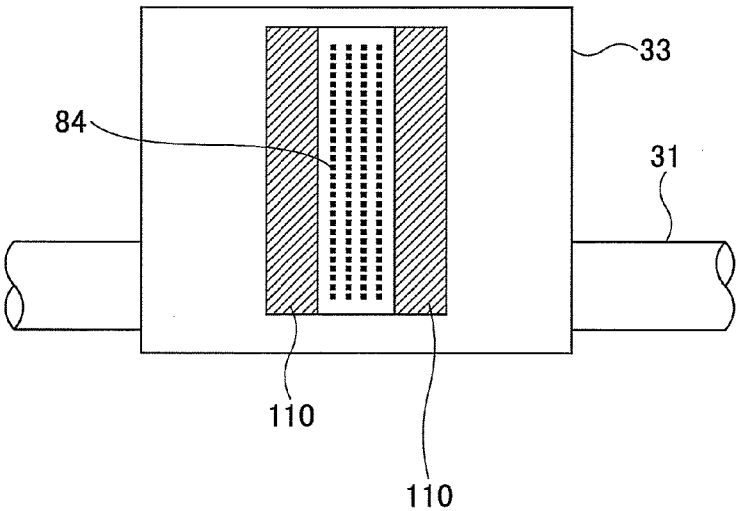
FIGS. 16A and 16B illustrate a mist collecting body provided around a nozzle plate on a carriage.
Figure 16A:
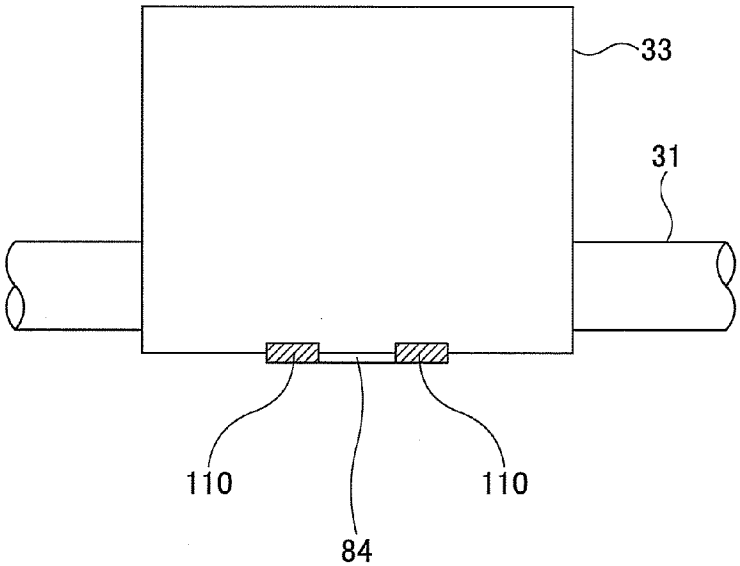

FIGS. 16A and 16B illustrate the mist collecting portion 110 disposed on either side of the nozzle area 84 on the carriage 33. FIG. 16A is a front view of the mist collecting portions 110 attached to the carriage 33 as seen from the downstream side of the sheet transport direction, i.e., from the front of the image forming apparatus 100. FIG. 16B is a bottom view of the mist collecting portion 110 attached to the carriage 33 as seen from below the carriage 33.

As mentioned above, the nozzle plate 81 may be covered with the charging portion 82 for charging the mist as illustrated in FIG. 4, for example. In the example of FIGS. 16A and 16B, the mist collecting portions 110 are utilized both for charging and collecting mist. In this way, the structure can be simplified. Because the charges for charging the mist (positive) and the charges for attracting the mist have the same polarity (negative), as described with reference to FIG. 3, the mist can be efficiently collected immediately as the mist is produced. Preferably, the charging portion 82 for charging the mist and the mist collecting portion 110 may be separately provided.

Preferably, the mist collecting portion 110 is located close to the nozzle area 84 as a mist source, and in such a manner as to sandwich the nozzle area 84 along the main-scan direction, as illustrated in FIGS. 16A and 16B. This is due to the following reasons. First, the arrangement allows for an efficient and immediate collection of the mist produced by the carriage 33 as it moves back and forth in the main-scan direction during a printing operation. Secondly, the arrangement enables an easy maintenance of the mist collecting portion 110 by the maintenance unit 88, so that the problems of the mist attaching to the mist collecting portion 110 and reducing the collection efficiency and the service life of the mist collecting portion 110 can be avoided. However, the collection of the mist under the carriage 33 may result in the collected mist dropping down onto the sheet 42, thus staining the sheet 42. Further, the collection of the mist near the nozzle area 84 may lead to the mist attaching to the nozzles, thus adversely affecting the ink-discharging performance of the nozzles.

Figure 17:
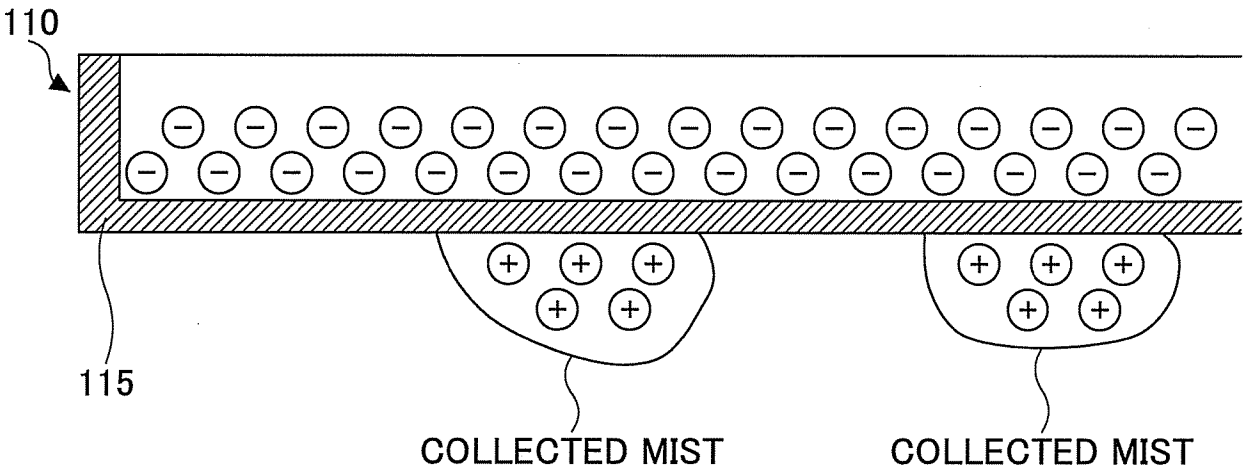
FIG. 17 illustrates the function of an insulating layer provided on a mist collecting body for a nozzle plate.

FIG. 17 illustrates an insulating layer 115 provided on the mist collecting portion 110 on the nozzle plate 81. By thus coating the mist collecting portion 110 with the insulating layer 115, corrosion of the surface of the mist collecting portion 110 can be prevented. Further, by preserving the charges of the mist, the charges can be utilized by the maintenance unit 88. Preferably, the polarities of the charges of the mist collecting body and the mist may be reversed from those of the illustrated example.

Corrosion of the surface of the mist collecting portion 110 is at least partly due to charge exchange, as in the foregoing example. Specifically, when there is no insulating layer on the surface of the mist collecting portion 110, charge exchange occurs between the ions in the ink and the surface of the mist collecting portion 110. When the mist collecting portion 110 is positive, anode corrosion occurs. When the mist collecting portion 110 is negative, cathode corrosion occurs. As a result, ionized metals may be freed from the metal surface of the mist collecting portion 110 and become instantaneously crystallized. Further, the components of the ink may be changed by charge exchange in such a manner as to result in the fixing of the ink on the mist collecting portion 110.

Figure 18:
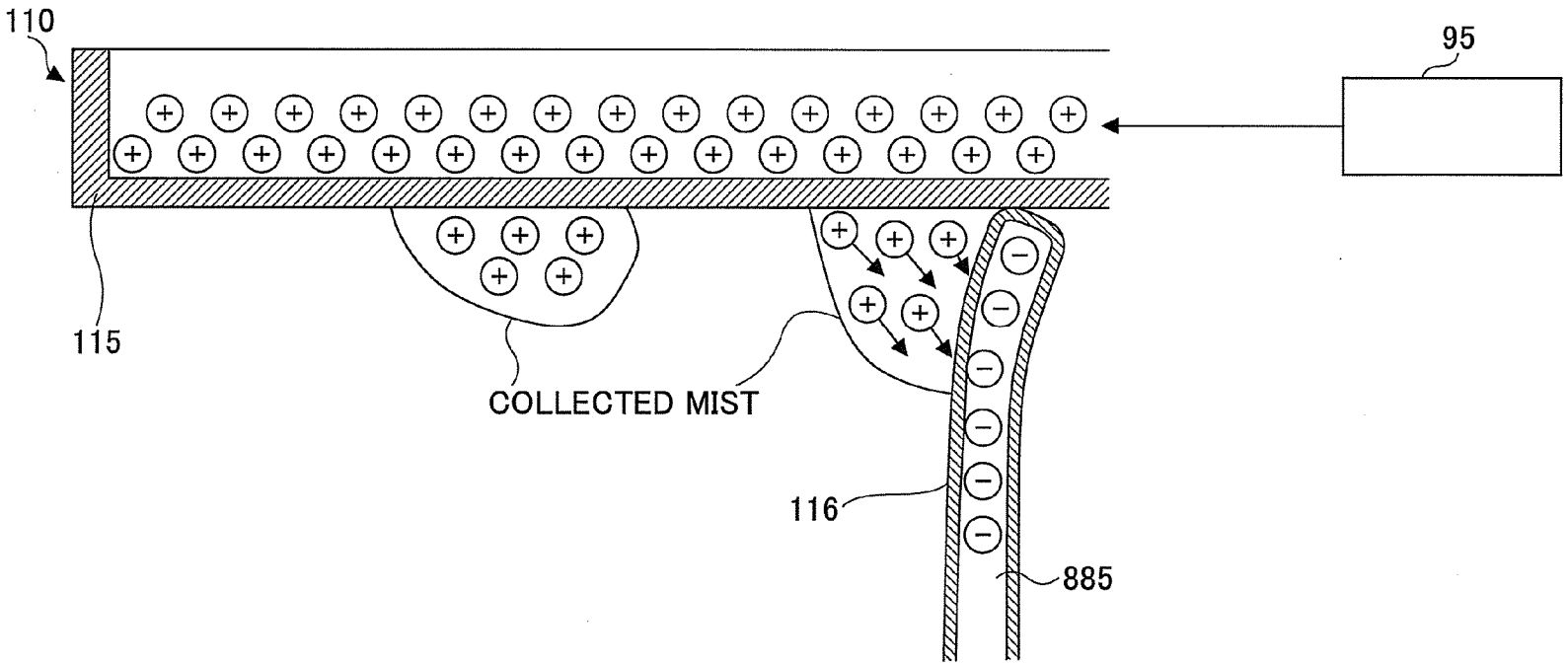
FIG. 18 illustrates a method of collecting mist according to an embodiment of the present invention.

FIG. 18 illustrates how the mist collected on the mist collection portion 110 of FIG. 17 may be removed by a cleaning blade 885 of the maintenance unit 88. In this example, the charges of the collected mist are utilized for maintenance purposes. Because the mist collecting portion 110 is provided with the insulating layer 115, the charges of the collected mist are preserved.

When the mist is removed by the cleaning blade 885 of the maintenance unit 88, the charge-switching mechanism 95 causes the mist absorbing portion 110 to be charged with the same polarity as that of the collected mist (i.e., from negative to positive in the illustrated example). As a result, the collected mist is repelled away from the mist collecting portion 110 by the Coulomb force, so that a maintenance operation can be performed efficiently.

By charging the cleaning blade 885 with the opposite polarity (negative) to the collected mist (positive) by the maintenance unit 88, which may be referred to as a "second charge-switching unit", the collected mist is pulled by the cleaning blade 885 by the Coulomb force, so that a maintenance operation can be performed more efficiently. For the maintenance unit 88, cleaning time is known. The cleaning blade 885 may be covered with an insulating layer 116 of a rubber or resin material, for example. In this way, charge exchange between the mist absorbing portion 110 and the cleaning blade 885 can be more reliably prevented. The polarities of the charges illustrated in FIG. 18 may be reversed.

If the mist attached to the bottom of the mist collecting portion 110 drops down, the mist may contact the sheet 42, thus staining it. In order to prevent such dropping of the mist and the eventual contact with the sheet 42, preferably the bottom surface of the mist collecting portion 110 is at least partially concave-shaped and therefore distanced away from the head surface, as illustrated in FIGS. 19 and 20.

Figure 19:
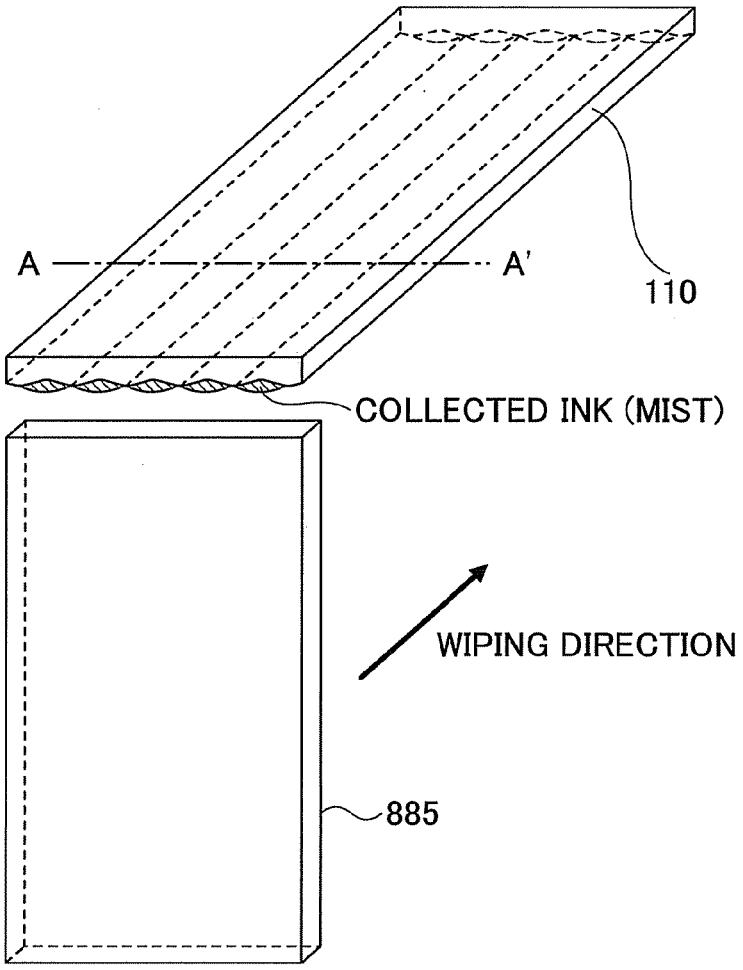
FIG. 19 is a perspective view of a mist collecting body illustrating how mist attaches to it.

FIG. 19 illustrates the mist collecting portion 110 which may be mounted on the nozzle plate 81 (not shown), where the collected mist is attached to the bottom of the mist collecting portion 110. FIG. 20 is a cross section taken along line A-A' of FIG. 19.

Figure 20:
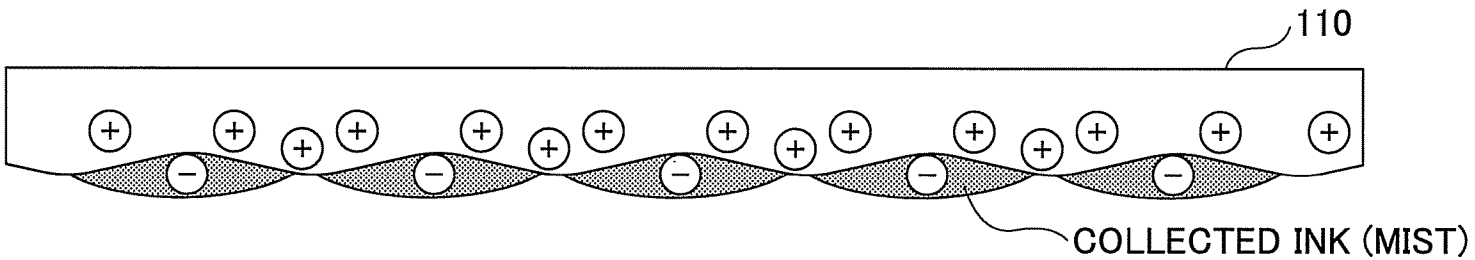
FIG. 20 is a cross section taken along line A-A' of FIG. 19.

As seen from FIGS. 19 and 20, the bottom surface of the mist collecting portion 110 is provided with a repeated pattern of concavities or a "scalloped" surface, which extends parallel to the longitudinal direction of the mist collecting portion 110 (i.e., a wiping direction of the maintenance unit 88 in which the nozzle openings may be arranged). The charge-switching mechanism 95 charges the mist collecting portion 110 to be opposite to the charge of the mist during the time of mist collection, so that the mist can be adsorbed on the bottom surface of the mist collecting portion 110.

Preferably, the distance between the sheet 42 and a head surface of the nozzle area 84 should be minimized so as to enable the formation of an accurate image and reduce mist generation. However, if the distance is too small, the sheet 42 may contact or scratch the head surface in case the sheet 42 undulates or is lifted as it is transported. Generally, the distance between the sheet 42 and the head surface is on the order of 1 mm to 2 mm.

In the examples illustrated in FIGS. 19 and 20, the concave portions are provided on the bottom surface of the mist collecting portion 110 opposite the transport surface 85 at regular intervals. The collected mist can remain in the concave portions due to surface tension. Because the concave portions recede upwardly from the surface of the nozzle area 84, a large amount of mist is required before an accumulation of the collected mist falls or drops and contacts the sheet 42, thus substantially preventing the contact of the mist with the sheet 42. Further, by charging the mist collecting portion 110 and the mist with opposite charges, as illustrated in FIG. 20, the mist can be collected in the concave portions more easily by the Coulomb force. Thus, by providing the bottom surface of the mist collecting portion 110 with a concave-convex form, the collected mist can be prevented from dropping beyond the head surface.

During a maintenance operation of the mist collecting portion 110, the collected mist is removed by the cleaning blade 885, as illustrated in FIG. 19. The cleaning blade 885 includes a sliding surface whose longitudinal direction is perpendicular to the longitudinal direction of the concave-convex pattern on the surface of the mist collecting portion 110. Thus, the cleaning blade 885 can wipe the mist collecting portion 110 parallel to the longitudinal direction of the concave-convex pattern of the mist collecting portion 110.

In the examples illustrated in FIGS. 19 and 20, the concave-convex pattern of the mist collecting portion 110 has relatively small intervals. In this configuration, the cleaning blade 885 may not be able to reach some of the concave portions of the mist collecting portion 110. However, by adopting the relatively small intervals of the concave-convex pattern of the mist collecting portion 110, the collected mist can more easily enter and reach the top (back) of the concave portions of the mist collecting portion 110, so that the dropping of the collected mist beyond the head surface can be more reliably prevented.

While in the examples of FIGS. 19 and 20 the concave-convex pattern comprises a wavy surface extending parallel to the wiping direction, the concave-convex pattern may comprise flat surfaces or a rectangular cross section. Preferably, the concave-convex pattern of the mist collecting portion 110 may be determined depending on the wettability of the surface of the mist collecting portion 110 with respect to the mist, the surface tension of the mist, the amount of charge in the mist, and the force of attraction due to the potential difference between the mist collecting portion 110 and the mist.

Figure 21:
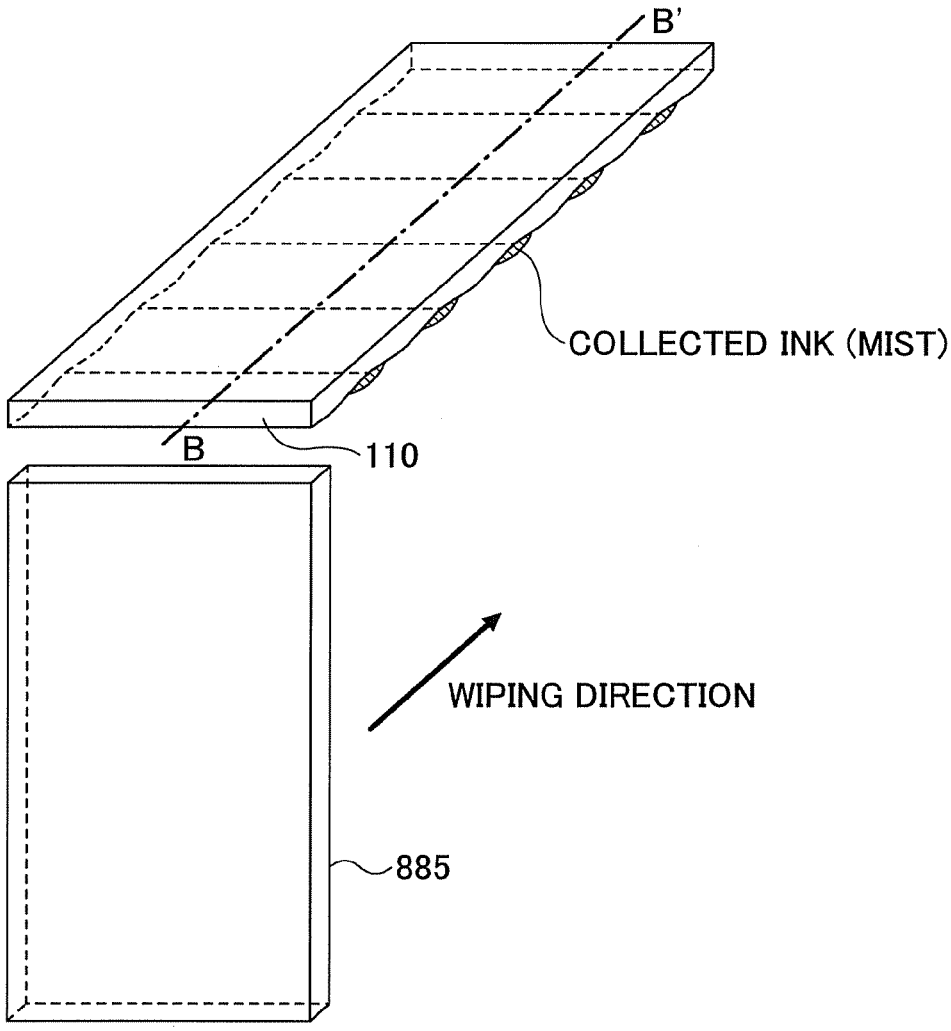
FIG. 21 is a perspective view of a mist collecting body according to another embodiment of the present invention.

FIG. 21 illustrates the mist collecting portion 110 according to another embodiment of the present invention, in which the concave portions are formed in a direction perpendicular to that of the example of FIG. 19. In the present embodiment, the concave portions extend in a direction perpendicular to the wiping direction of the cleaning blade 885, forming a wavy pattern having relatively long intervals. The distance between the bottom of the concave portions and the head surface of the nozzle area 84 is relatively small. In this configuration, the amount of mist that can be collected may be reduced a little compared to the configuration of FIG. 19. However, the cleaning blade 885 may be able to better follow the contour of the concave-convex pattern of the mist collecting portion 110 as the cleaning blade 885 wipes the mist collecting portion 110. Thus, the cleaning blade 885 can wipe the mist collecting portion 110 without leaving an un-wiped portion.

Figure 22A:
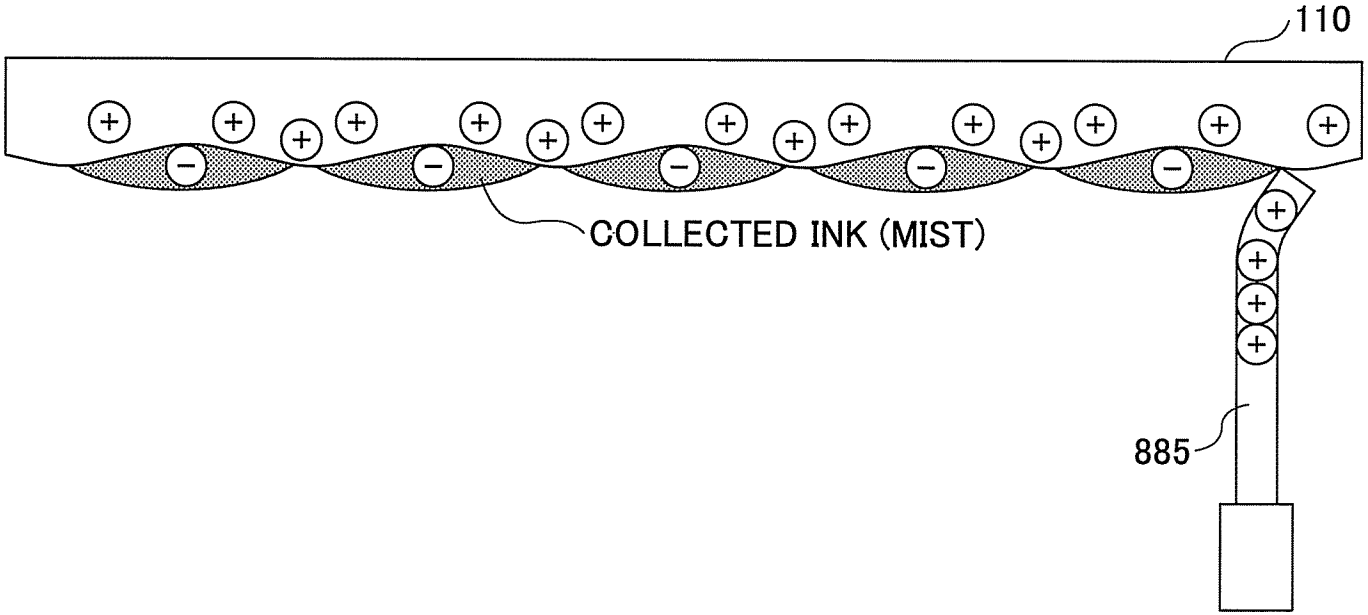
FIGS. 22A and 22B are cross sections taken along line B-B' of FIG. 21.
Figure 22B:
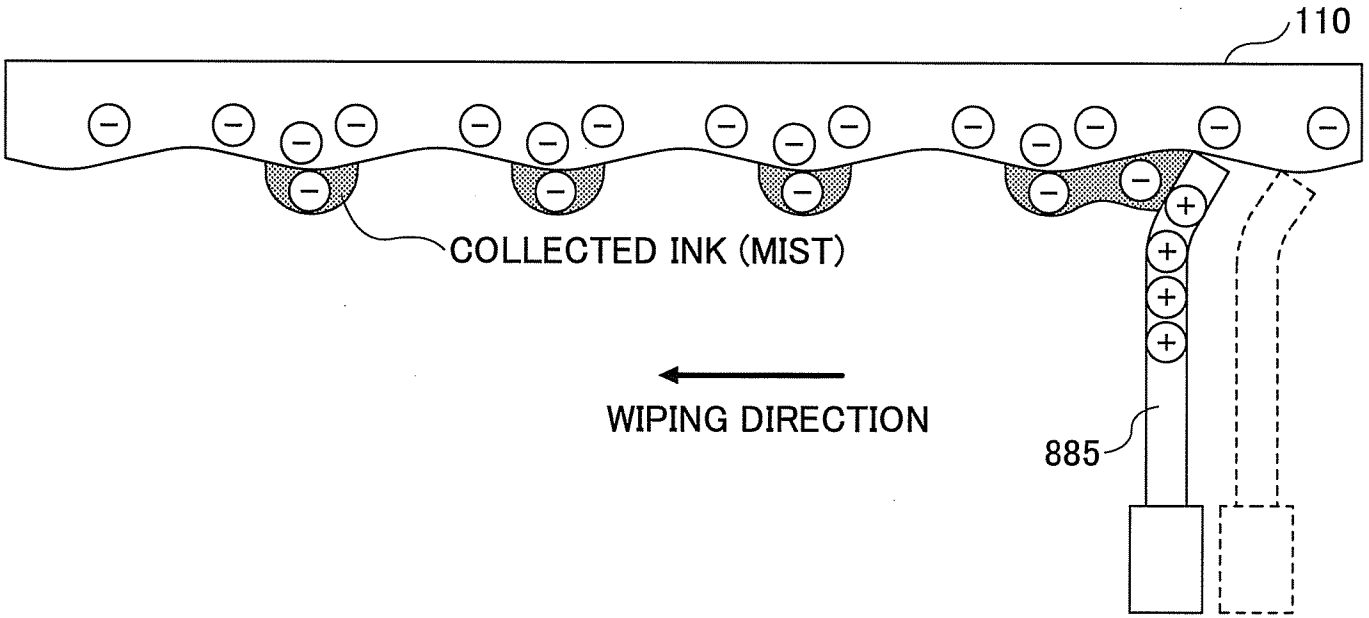

FIG. 22A is a cross section taken along line B-B' of FIG. 21. As illustrated in FIG. 22A, the mist collected by the mist collecting portion 110 remains in the concave portions of the concave-convex pattern. In the example of FIG. 22A, the polarities of the mist collecting portion 110 and the mist are opposite. FIG. 22B illustrates how the mist collecting portion 110 is charged during a maintenance operation. As illustrated in FIG. 22B, during the maintenance operation of the mist collecting portion 110, the polarities of the mist collecting portion 110 are switched to be the same polarity (negative) as the polarity of the mist, so that the mist can be more easily separated. Preferably, the cleaning blade 885 may be made of a conductive material and charged with the opposite polarity (positive) to that of the mist or grounded during the maintenance operation.

In this case, the longitudinal direction of the sliding surface of the cleaning blade 885 is parallel to the direction in which the concave grooves of the mist collecting portion 110 extend. Thus, the cleaning blade 885 wipes the surface of the mist collecting portion 110 in a direction perpendicular to the longitudinal direction of the concave grooves. Thus, the sliding surface of the cleaning blade 885 can easily reach the bottoms of the concave portions and remove the mist efficiently.

In the examples of FIGS. 21A through 22B, the concave-convex pattern of the mist collecting portion 110 may be determined depending on the size and shape of the cleaning blade 885, the wettability of the surface of the mist collecting portion 110 with respect to the mist, the surface tension of the mist, the amount of charge in the mist, and the force of attraction between the mist collecting portion 110 and the mist due to a potential difference.

Figure 23A:
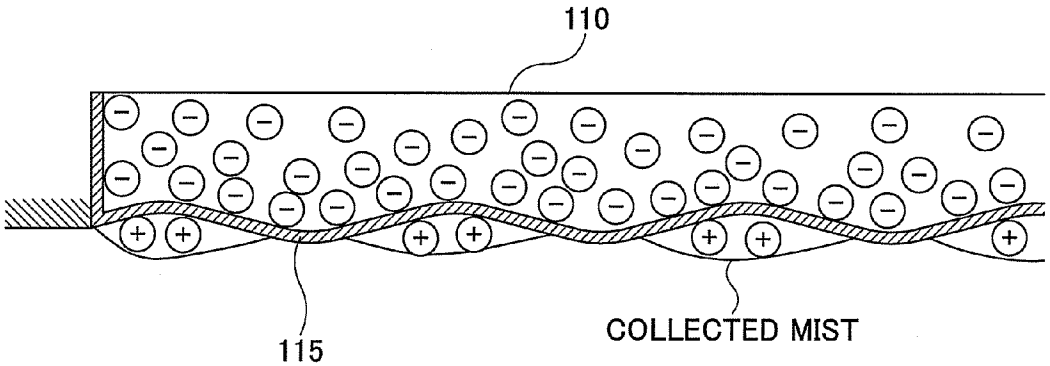
FIGS. 23A and 23B illustrate how the mist collecting body is charged when the collected mist is removed by a cleaning blade.
Figure 23B:
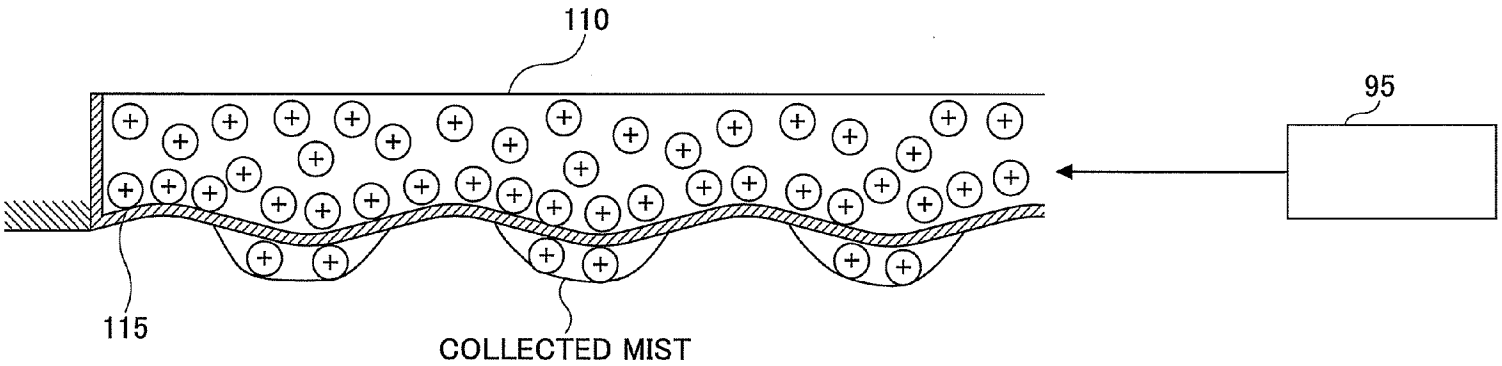

FIG. 23A illustrates how the mist collecting portion 110 is charged during a mist collecting operation. FIG. 23B illustrates how the mist collecting portion 110 is charged when the cleaning blade 885 removes the collected mist in a maintenance operation. When the collected mist is removed by the cleaning blade 885 for maintenance, the potential of the mist collecting portion 110 is switched to be the same (positive) as the mist by the charge-switching mechanism 95 from when the mist collection is performed, as illustrated in FIG. 23B. In this way, the mist can be more easily separated.

Preferably, at the time of maintenance, the conductive cleaning blade 885 may be charged with the opposite polarity to the mist or grounded, as in the embodiment illustrated in FIG. 18. In this way, the amount of mist that is left remaining in areas of the concave portion that the cleaning blade 885 fail to contact can be minimized. The polarities of the charges illustrated in FIG. 23 may be reversed.

Figure 24:
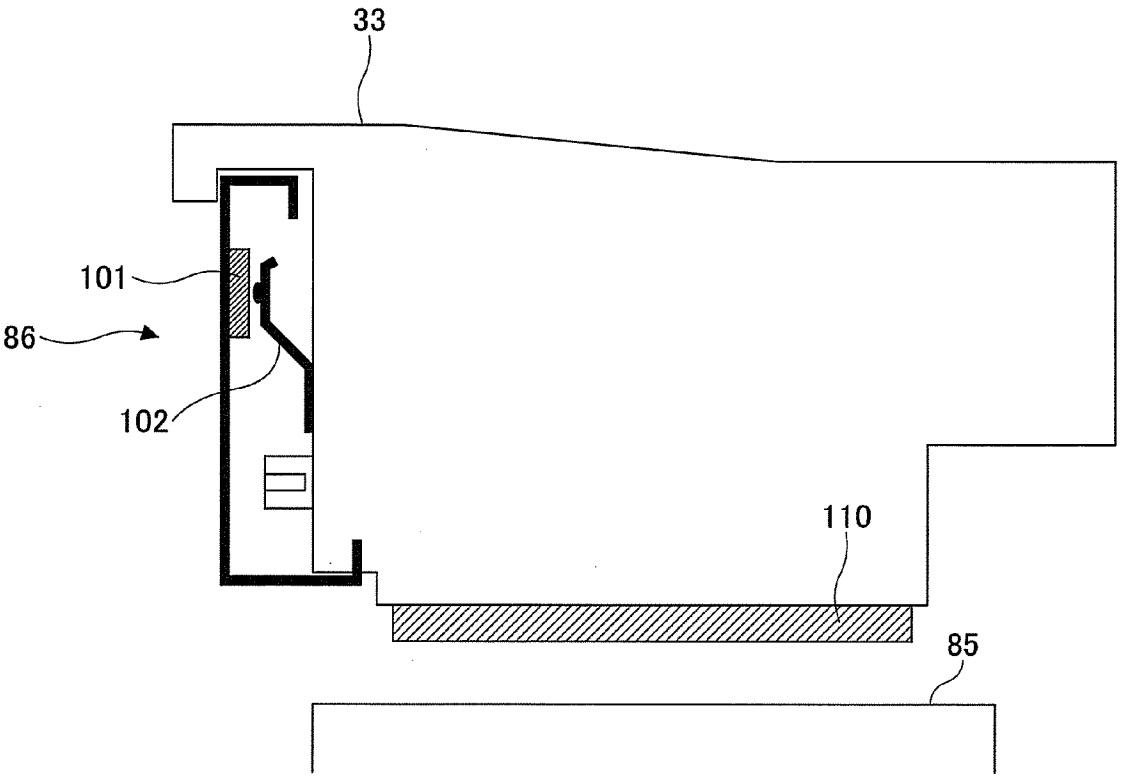
FIG. 24 is a side view of a carriage.

With reference to FIG. 24, a connection-switching mechanism 86 for the mist collecting portion 110 (not shown in FIG. 24) is described. In accordance with the present embodiment, the mist collecting portion 110 is of a capacitor type, including the capacitor-type charging portion 82 illustrated in FIG. 6. Thus, the connection-switching mechanism 86 is used in place of the charge-switching mechanism 95 of the foregoing embodiments. In the configuration of FIG. 24, the polarity of the charges of the mist collecting portion 110 mounted on the carriage 33 can be switched by a simple mechanism. The connection-switching mechanism 86 includes a leaf spring 102 and a ground-switching plate 101. For the charging of the capacitor-type mist collecting portion 110, electrostatic induction by the charges on the transport surface 85 is utilized. When the ground-switching plate 101 and the leaf spring 102 are connected to each other, the mist collecting portion 110 is grounded.

Figure 25A:
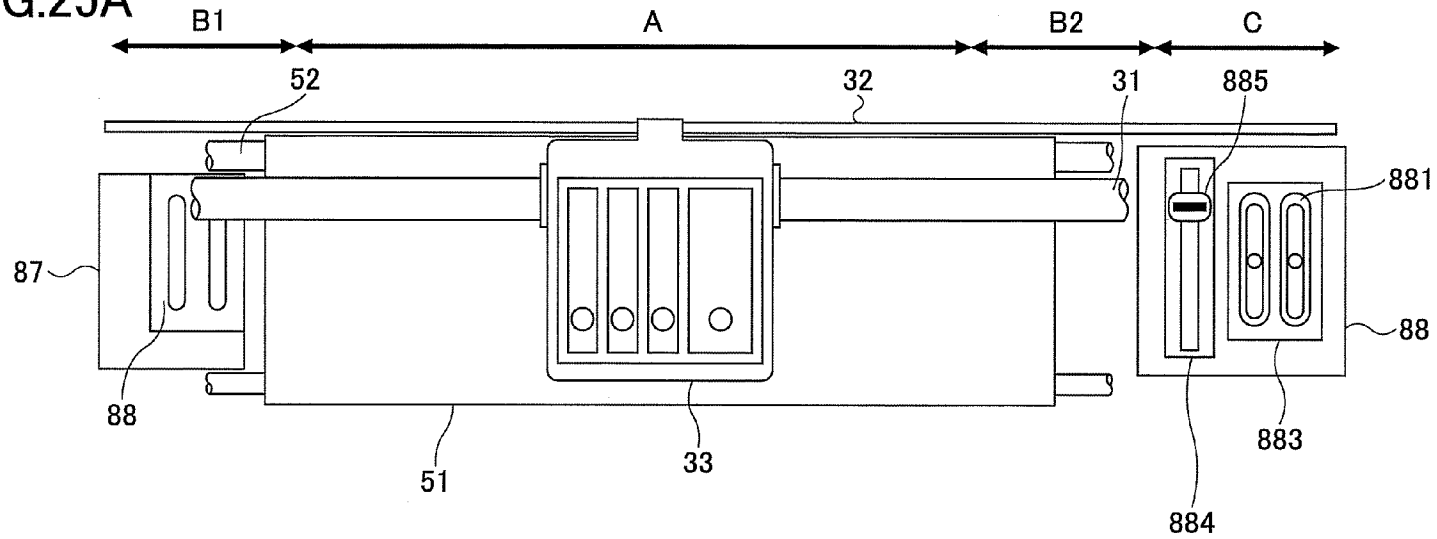
FIG. 25A is a plan view of a main part of the image forming apparatus.

Referring to FIG. 25A, the area of movement of the carriage 33 is divided into areas A, B1, B2, and C. The area A is an image-forming area in which the carriage 33 is moved when forming an image. The area B1 on the left corresponds to the blank discharge unit 87. The area B2 on the right is located between the area A and the maintenance unit 88. The area C corresponds to the maintenance unit 88.

Figure 25B:
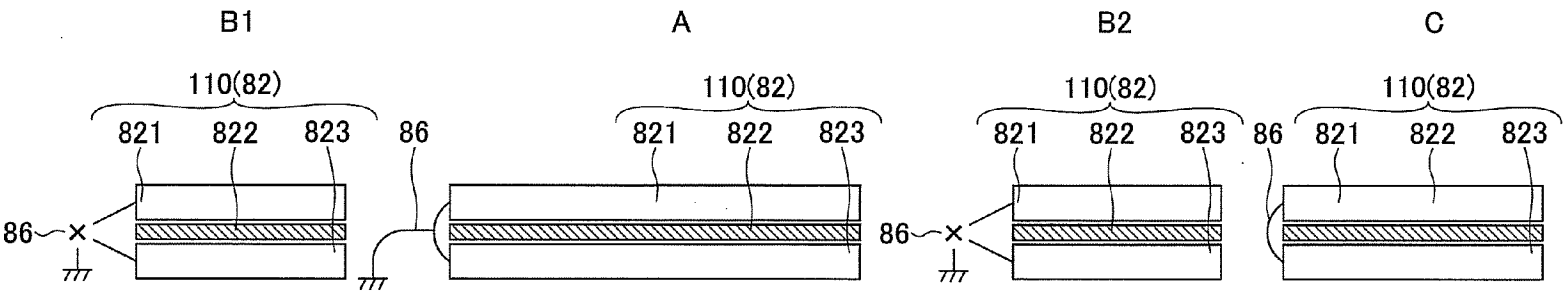
FIG. 25B illustrates cross-sectional views of a charging unit.

FIG. 25B illustrates the correspondence between a connection state of the charging portion 82 controlled by the connection-switching mechanism 86 of FIG. 24 and the movement areas A, B1, B2, and C of the carriage 33. When the carriage 33 is moving in the movement area A, the ground-switching plate 101 is in contact with the leaf spring 102 so that they are electrically connected to each other. Thus, the two electrodes of the capacitor of the mist collecting portion 110 are electrically connected to each other. Thus, due to the influence of the charges on the transport surface 85 opposite the carriage 33, the layer of the capacitor of the mist collecting portion 110 facing the transport surface 85 is charged with the opposite polarity to that of the transport surface 85 by electrostatic induction.

In the areas B1 and B2 of FIG. 25, the ground-switching plate 101 and the leaf spring 102 are disconnected from each other. As a result, the two electrodes of the capacitor of the mist collecting portion 110 are also disconnected. Thus, the charges of the capacitor charged by the transport surface 85 are preserved. Still referring to FIG. 25B, in the area C, the connection between the ground-switching plate 101 and the leaf spring 102 is controlled depending on the operation of the cleaning blade 885. Specifically, when the cleaning blade 885 wipes the mist collecting portion 110, the ground-switching plate 101 is connected to the leaf spring 102. As a result, the electrodes of the capacitor of the mist collecting portion 110 are electrically connected to each other, so that the capacitor is charged with the opposite polarity to that of the cleaning blade 885 by electrostatic induction, thus achieving the relative polarities illustrated in FIG. 18. Thus, the collected mist can be efficiently removed; namely, the maintenance operation can be properly performed. In this case, the need to provide the carriage 33 with a charging mechanism is eliminated.

The above operation may be realized by detecting the position of the carriage 33 using the encoder sensor 92, and controlling the connection between the ground-switching plate 101 and the leaf spring 102 and the connection of the electrodes of the capacitor under the control of a main system (such as a CPU).

Figure 26B:
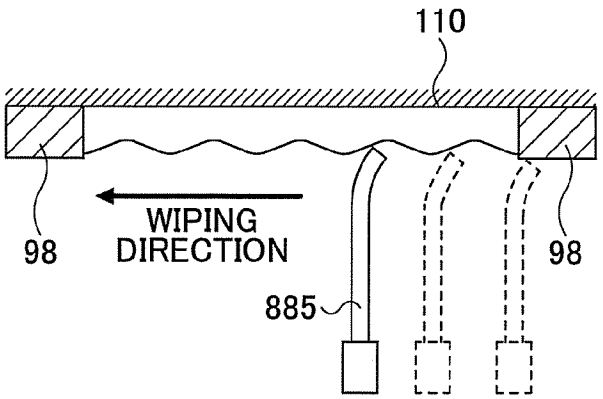
FIGS. 26A and 26B illustrate how an ink portion remains on a mist collecting body and how the remaining ink portion can be prevented according to an embodiment of the present invention.
Figure 26A:
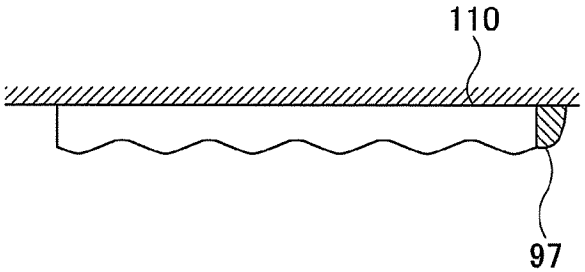

FIG. 26A illustrates the mist collecting portion 110 on which a mist portion 97 left un-wiped by the cleaning blade 885 remains. The un-wiped mist portion 97 may remain because there is a step between the mist collecting portion (nozzle plate 81) 110 and the carriage 33 that the cleaning blade 885 cannot reach.

In FIG. 26B, a non-conductive material 98 are provided around the mist collecting portion 110 (nozzle plate 81) in order to eliminate the un-wiped mist portion 97. The non-conductive material 98 may be disposed in such a manner as to surround the mist collecting portion 110 such that the step between the mist collecting portion 110 (nozzle plate 81) and the carriage 33 can be eliminated. In this way, the mist collected by the mist collecting portion 110 (nozzle plate 81) can be prevented from flowing outside the mist collecting portion 110 and instead caused to stay within the concave portions of the mist collecting portion 110. Thus, by disposing the non-conductive members 98 around the mist collecting portion 110 (nozzle plate 81) as illustrated in FIG. 26B, the concave portions of the mist collecting portion 110 can be thoroughly wiped by the cleaning blade 88, thereby preventing the wiping failure.

Figure 27:
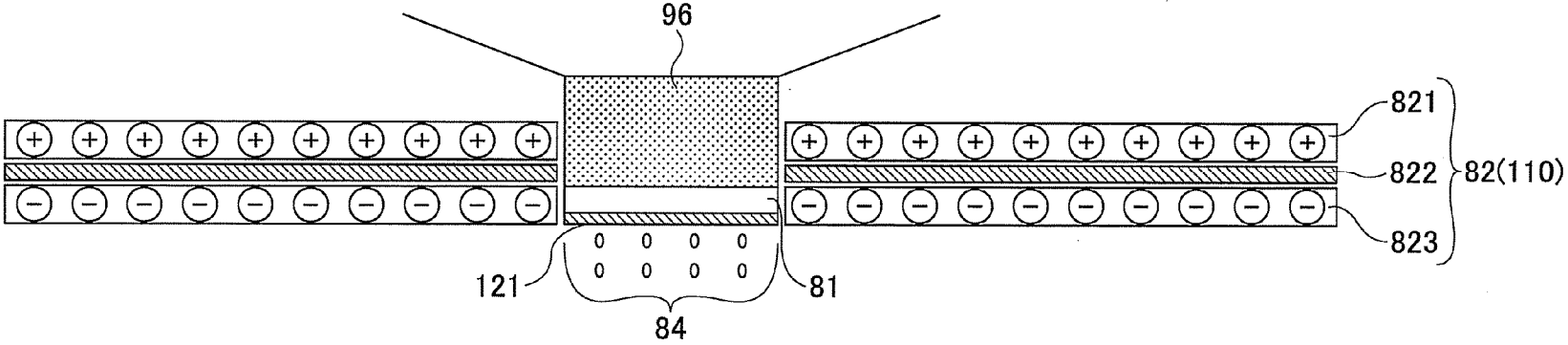
FIG. 27 is a cross section of a mist collecting body in which a nozzle plate is coated with an insulating layer.

FIG. 27 illustrates the coating of a surface of the nozzle area 84 facing the transport surface 85 with an insulating coating 121. The insulating coating 121 divides the charging portion 82 to left and right portions. The nozzle plate 81 is not grounded. In the illustrated example, the charging portion 82 may also function as the mist collecting portion 110.

In this case, if there is a potential difference between the nozzle plate 81 and the charging portion 82, the charging portion 82 may be charged by the nozzle plate 81 through electrostatic induction. Thus, the charging portion 82 may preferably have strong charges of the opposite potential to the mist such that the influence of electrostatic induction by the nozzle plate 81 can be disregarded.

By using the insulating layer 121 on the nozzle plate 81, the influence of the charges of the opposite transport surface can be reduced, thus preventing the attachment of the mist to the nozzles. Because the nozzle plate 81 is not grounded, the charges are prevented from escaping from the charging portion 82, thus reducing a shift in the distribution of charges caused by the nozzle plate 81 via electrostatic induction. The polarities of the charges illustrated in FIG. 27 may be reversed.

Figure 28:
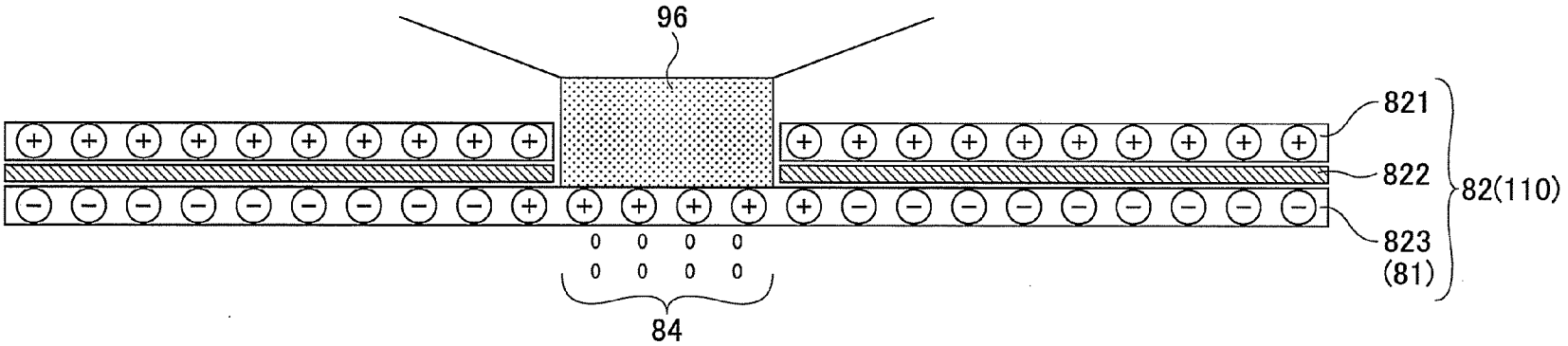
FIG. 28 is a cross section of a mist collecting body in which a nozzle plate is provided in a nozzle area.

FIG. 28 illustrates a variation of the structure illustrated in FIG. 27. In this variation, the size of the nozzle plate 81 is increased compared to that in FIG. 27 such that it forms a part of the charging portion 82 (mist collecting portion 110). Namely, one of the electrodes of the capacitor is present in the nozzle area 84 too. Because of the presence of a flow-channel plate 96, a part of the nozzle plate 81 does not have an opposite electrode. The mist collecting portion 110 may be configured to utilize the transfer of charges by electrostatic induction.

Thus, the polarity of the part of the nozzle plate 81 opposite the flow-channel plate 96 can be made the same as the polarity of the mist (i.e., opposite to the polarity of the other portions of the nozzle plate 81). Therefore, the attachment of the mist to the portion of the nozzle plate 81 where the ink droplets and mist tend to contact more readily can be prevented. The polarities of the charges illustrated in FIG. 28 may be reversed.

Figure 29:
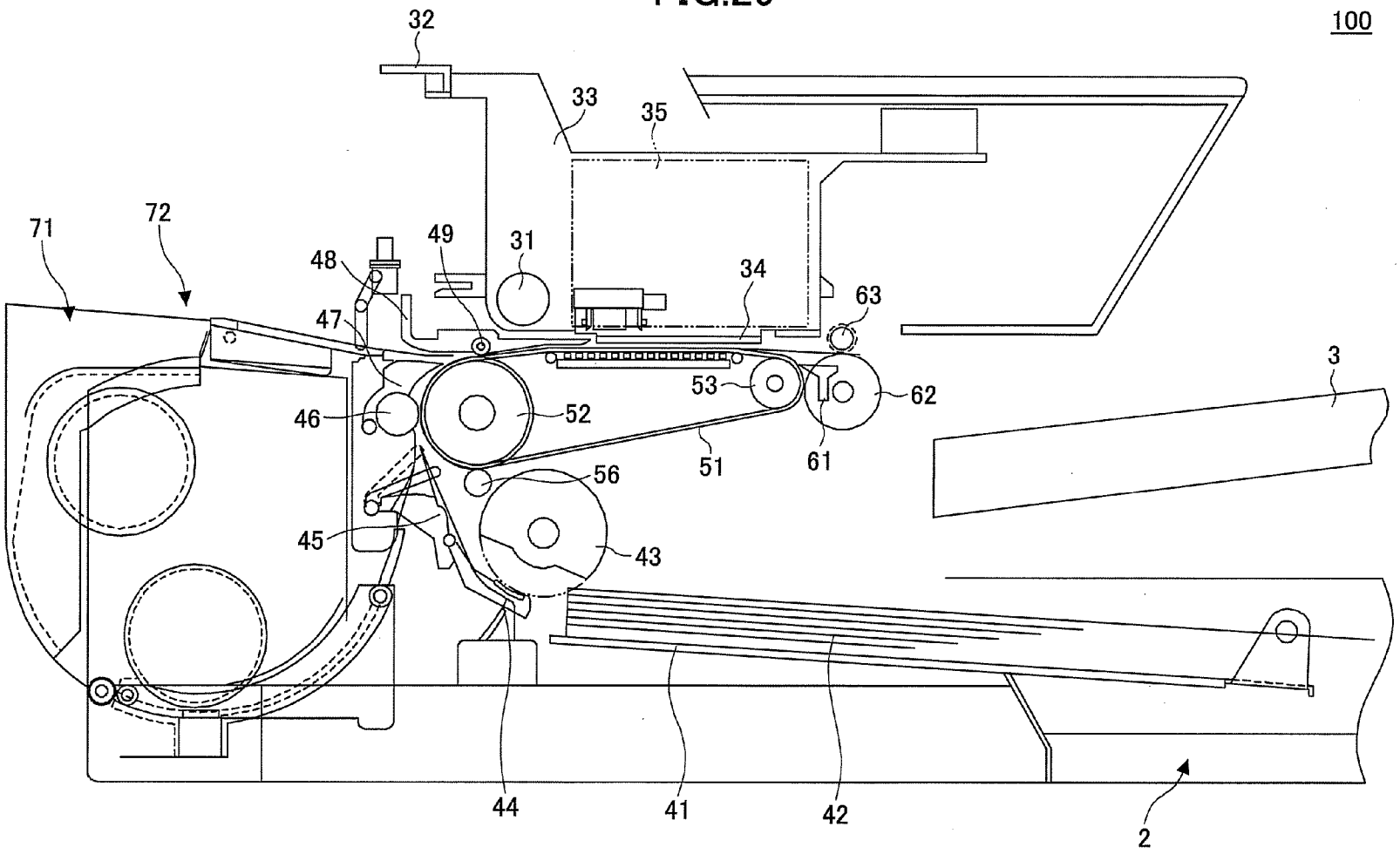
FIG. 29 is a lateral cross section of an image forming apparatus according to an embodiment of the present invention.
Figure 30:
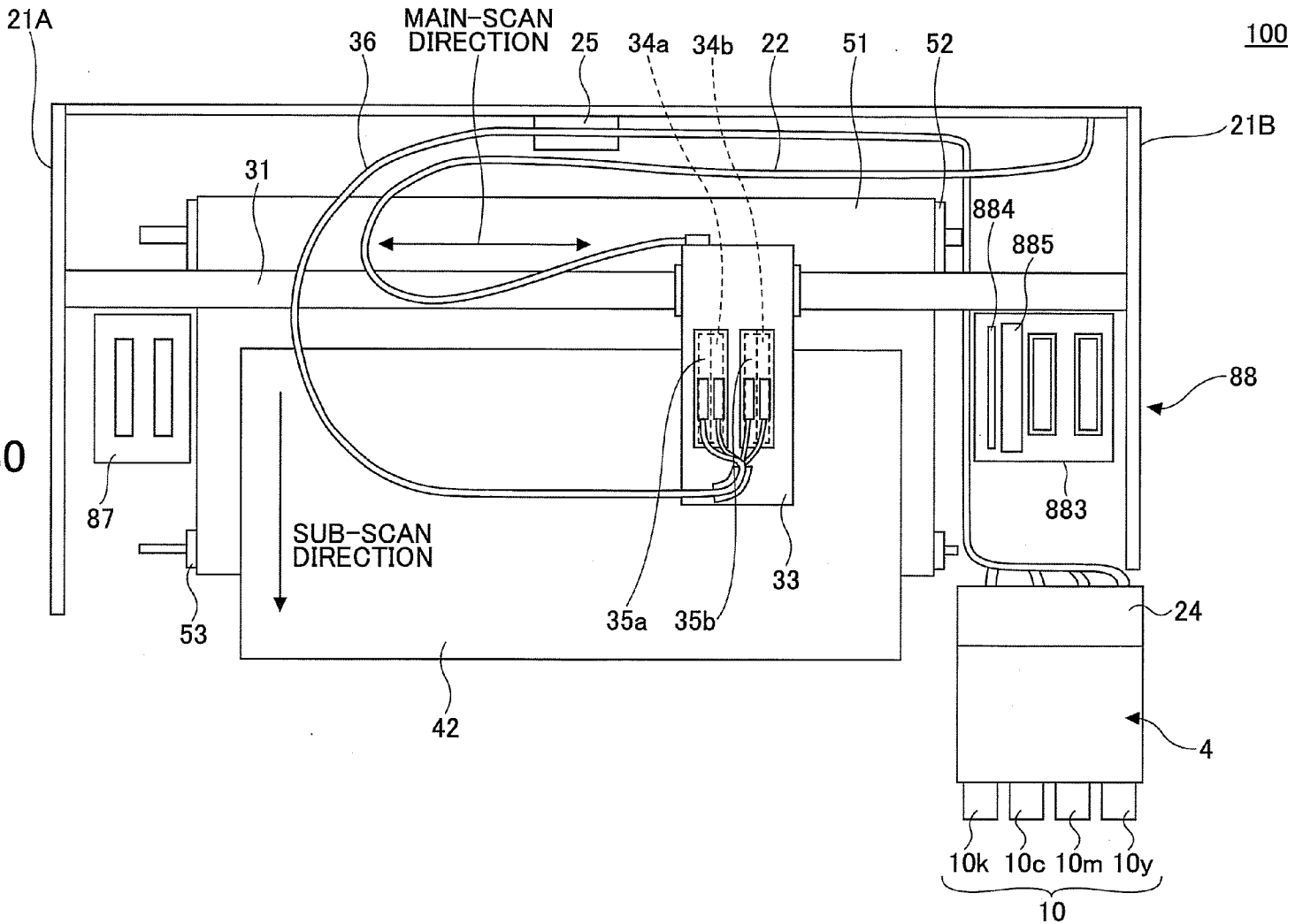
FIG. 30 is a plan view of a main portion of the image forming apparatus.

Next, an inkjet image formation process is described. FIG. 29 is a cross-sectional lateral view of the inkjet image forming apparatus 100. FIG. 30 is a plan view of a main part of the inkjet image forming apparatus 100. The carriage 33 is slidably supported on the guide rod 31 (guide member) laterally extended between left and right side plates 21A and 21B and a stay 32, so that the carriage 33 can be moved in the main-scan direction indicated in FIG. 30 by a main-scan motor (not shown) via a timing belt, for example.

The carriage 33 carries the recording heads 34*a* and 34*b* (either of which may be referred to as "the recording head 34") for discharging droplets of ink of the various colors of yellow (Y), cyan (C), magenta (M), and black (K). The recording head 34 has two lines of plural nozzles extending in the sub-scan direction, with the nozzles directed toward the sheet 42.

The recording head 34*a* has one line of nozzles configured to discharge droplets of black (K) and the other line of nozzles configured to discharge droplets of cyan (C). The recording head 34*b* has one line of nozzles configured to discharge droplets of magenta (M) and the other line of nozzles configured to discharge droplets of yellow (Y).

The recording head 34 (inkjet head) includes a pressure-generating unit configured to generate a pressure for discharging the ink droplets. The pressure-generating unit may comprise a piezoelectric actuator such as a piezoelectric element; a thermal actuator configured to utilize a phase change based on the film boiling of a liquid caused by an electro-thermal conversion element, such as a heat-generating resistor; a shape memory alloy actuator configured to utilize a metal phase change caused by a temperature change; and an electrostatic actuator utilizing electrostatic force.

The carriage 33 also carries head tanks 35*a* and 35*b* (either of which may be referred to as "the head tank 35") which are liquid containers for storing the ink of various colors that is supplied to the nozzles of the corresponding colors. The head tank 35 may be configured to be refilled with the ink of the various colors from ink cartridges 10*k*, 10*c*, 10*m*, and 10*y* (either of which may be referred to as "the ink cartridge 10") mounted on a cartridge charging unit 4 via an ink supply tube 36. The cartridge charging unit 4 includes a supply pump unit 24 for pumping the ink out of the ink cartridge 10.

Referring to FIG. 29 in particular, a sheet-feeding unit includes a half-moon roller (sheet-feeding roller) 43 and a separating pad 44. The sheet-feeding unit is configured to feed the sheets 42 of recording medium from the sheet mount portion (pressure plate) 41 of the sheet-feeding tray 2 one sheet at a time. The separating pad 44 is made of a material having a high coefficient of friction and biased toward the sheet-feeding roller 43.

The sheet 42 fed from the sheet-feeding unit is guided by a guide member 45 and transported under the recording head 34 via a counter roller 46, a transport guide member 47, and a pressing member 48 having an edge-pressing roller 49, while the sheet 42 is electrostatically held on the transport belt 51 (transport unit). The transport belt 51 is an endless belt extended across the transport roller 52 and a driven roller 53, and configured to rotate in a belt transport direction (sub-scan direction). The inkjet image forming apparatus 100 also includes a charging roller 56 (charging unit) for electrically charging the surface of the transport belt 51. The charging roller 56 is configured to contact a surface layer of the transport belt 51 such that the charging roller 56 can be rotated by the transport belt 51. The transport belt 51 may be rotated in the belt transport direction by the transport roller 52 driven by a sub-scan motor (not shown) via a timing belt (not shown).

As a sheet-ejecting unit for ejecting the sheet 42 after recording by the recording head 34, the inkjet image forming apparatus 100 includes a separating nail 61 for separating the sheet 42 from the transport belt 51, a sheet-ejecting roller 62, and a sheet-ejecting roller 63. A sheet-ejecting tray 3 is provided under the sheet-ejecting roller 62.

On a back portion (on the left-hand side in FIG. 29) of the apparatus main body 1, a both-sides unit 71 is detachably provided. The both-sides unit 71 is configured to take in the sheet 42 as the sheet 42 is transported back by a reverse rotation of the transport belt 51, invert the sheet 42, and again feed the sheet 42 between the counter roller 46 and the transport belt 51. A manual-feed tray 72 is provided on top of the both-sides unit 71.

Referring mainly to FIG. 30, in a non-printing area on one end of the carriage 33 along the main-scan direction, a maintenance unit 88 including a recovery unit for maintaining and recovering a proper state of the nozzles of the recording head 34 is provided. The maintenance unit 88 includes the capping unit 883 for capping the nozzle area 84 (see FIG. 5) of the recording head 34, and the cleaning blade 885 (blade member) for wiping the nozzle area 84.

In another non-printing area on the other end of the carriage 33 along the main-scan direction, the blank-discharge unit 87 for receiving droplets discharged during the blank-discharge operation, in which ink with increased viscosity that does not contribute to a recording operation, is ejected. The blank-discharge unit 87 may have an opening extending along the lines of nozzles of the recording head 34.

In the inkjet image forming apparatus 100, the sheet 42 fed from the sheet-feeding tray 2 is guided substantially vertically upward by the guide member 45, and then transported between the transport belt 51 and the counter roller 46. Further, the front-end of the sheet 42 is guided by the transport guide member 47 such that the sheet 42 can be pressed onto the transport belt 51 by the edge-pressing roller 49, thus executing a substantially 90° change in transport direction.

At this time, the charging roller 56 is supplied with an alternating voltage that alternates between positive and negative outputs. As a result, the transport belt 51 is charged with an alternating charge voltage pattern, i.e., bands of positive and negative charges having predetermined widths alternately appearing along the sub-scan direction in which the transport belt 51 is rotated. Thus, when the sheet 42 is fed onto the transport belt 51, the sheet 42 is attracted onto the transport belt 51. Thus, the sheet 42 is transported by the rotating movement of the transport belt 51 in the sub-scan direction.

In a recording operation, the recording head 34 is driven in accordance with an image signal while the carriage 33 is moved, and a line of an image, a character and the like is recorded on the sheet 42 when it is stationary as droplets of ink are discharged by the moving recording head 34. After the sheet 42 is transported by a predetermined amount in the sub-scan direction, the next line is recorded on the sheet 42. The recording operation may be terminated in response to a recording end signal or a signal indicating that the rear-edge of the sheet 42 has reached the recorded area. Then, the sheet 42 is ejected onto the sheet-ejecting tray 3.

During a print (recording) stand-by period, the carriage 33 may be moved to the maintenance unit 88, where the recording head 34 is capped with the cap 881 of the capping unit 883 so as to maintain a wet nozzle state and thus prevent a discharge defect by the drying of ink. In a recovery (head or nozzle suction) operation for ejecting ink with increased viscosity or air bubbles, the ink is suctioned out via the nozzles using a suction pump (not shown) with the recording head 34 capped by the capping mechanism 883. Before or during a recording operation, a blank-discharge operation may be performed by the blank discharge unit 87 in which ink that does not contribute to recording is discharged. In this way, a stable discharge performance of the recording head 34 can be maintained.

Although this invention has been described in detail with reference to certain embodiments, variations and modifications exist within the scope and spirit of the invention as described and defined in the following claims.

The present application is based on Japanese Priority Applications No. 2009-255641 filed Nov. 9, 2009, No. 2010-020617 filed Feb. 1, 2010, and No. 2010-125027 filed May 31, 2010, the entire contents of which are hereby incorporated by reference.

What is claimed is:

1. An image forming apparatus comprising:

a recording head configured to discharge an electrically substantially neutral droplet of ink in an ink ejection direction onto a recording medium;

a transport unit configured to transport the recording medium such that a recording surface of the recording medium is substantially orthogonal with respect to an ink discharge direction of the recording head;

an electric field generating unit configured to generate an electric field when the recording head discharges the droplet of ink;

an ink mist collecting unit disposed near the recording head and having a mist collecting surface for collecting a mist of the ink formed by a part of the discharged droplet of ink being scattered during travel of the discharged droplet from the recording head to the recording medium;

a maintenance unit configured to move along the mist collecting surface and remove the mist collected by the ink mist collecting unit; and a charge-switching unit configured to switch the polarity of the ink mist collecting unit to an opposite polarity, which is opposite to a polarity of the collected mist, when the ink mist collecting unit collects the mist charged by the electric field, wherein when the maintenance unit moves along the mist collecting surface to remove the mist collected by the ink mist collecting unit, the charge-switching unit switches the polarity of the ink mist collecting unit to the same polarity as that of the charged mist.

2. The image forming apparatus according to claim 1, wherein the electric field generating unit generates the electric field by charging a surface of the recording medium.

3. The image forming apparatus according to claim 1 wherein the transport unit includes a belt, and the electric field generating unit generates the electric field by charging a surface of the belt.

4. The image forming apparatus according to claim 1, further comprising a carriage on which the recording head is mounted and which executes a reciprocating motion in a main-scan direction, wherein the electric field generating unit generates the electric field by charging a surface of the carriage facing the recording medium.

5. The image forming apparatus according to claim 1, wherein the electric field generating unit generates the electric field by charging a nozzle plate disposed on the recording head, wherein the nozzle plate has a nozzle opening for discharging the droplet of ink.

6. The image forming apparatus according to claim 1, further comprising a nozzle plate disposed on the recording head, wherein the nozzle plate has a nozzle opening for discharging the droplet of ink and includes a capacitor having two layers of electrodes.

7. The image forming apparatus according to claim 1, wherein the charge-switching unit switches the polarity of the ink mist collecting unit regularly.

8. The image forming apparatus according to claim 1, wherein the charge-switching unit switches the polarity of the ink mist collecting unit between a mist collection operation and a maintenance operation for the ink mist collecting unit.

9. The image forming apparatus according to claim 1, further comprising:

a cleaning unit for cleaning the ink mist collecting unit; and a second charge-switching unit configured to switch a polarity of the cleaning unit, wherein the second charge-switching unit switches the polarity of the cleaning unit to an opposite polarity to the mist during a maintenance operation for the ink mist collecting unit.

10. The image forming apparatus according to claim 6, wherein the ink mist collecting unit is disposed on the recording head together with the nozzle plate.

11. The image forming apparatus according to claim 6, wherein the transport unit includes a belt a surface of which is configured to be charged by the electric field generating unit, and one of the electrodes of the capacitor of the nozzle plate includes a nozzle area having nozzle openings and is charged by a charge on the surface of the belt via electrostatic induction.

12. The image forming apparatus according to claim 11, wherein the nozzle area forms a part of the one electrode of the capacitor, and a gap is formed in a part of the other electrode opposite the nozzle area, wherein the nozzle area and a portion of the one electrode adjacent the nozzle area are charged with the opposite polarity to the polarity of the remaining portion of the one electrode.

* * * * *